US008237700B2

(12) United States Patent
Zhao

(10) Patent No.: US 8,237,700 B2
(45) Date of Patent: Aug. 7, 2012

(54) SYNCHRONIZED PHASE-SHIFTED PULSE WIDTH MODULATION SIGNAL GENERATION

(75) Inventor: Bin Zhao, Irvine, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 352 days.

(21) Appl. No.: 12/625,818

(22) Filed: Nov. 25, 2009

(65) Prior Publication Data

US 2011/0121761 A1 May 26, 2011

(51) Int. Cl.
*G09G 5/00* (2006.01)

(52) U.S. Cl. ..... 345/213; 345/82; 345/212; 345/204; 345/94

(58) Field of Classification Search ..... 345/213, 345/212, 214, 204, 99, 100, 94, 82; 315/247, 315/209 R, 224, 225, 291, 246, 307–311
See application file for complete search history.

(56) References Cited

U.S. PATENT DOCUMENTS

| | | | |
|---|---|---|---|
| 4,162,444 | A | 7/1979 | Rodgers |
| 4,615,029 | A | 9/1986 | Hu et al. |
| 4,649,432 | A | 3/1987 | Watanabe et al. |
| 4,686,640 | A | 8/1987 | Simison |
| 4,907,862 | A | 3/1990 | Suntola |
| 5,025,176 | A | 6/1991 | Takeno |
| 5,038,055 | A | 8/1991 | Kinoshita |
| 5,508,909 | A | 4/1996 | Maxwell et al. |
| 5,668,611 | A | 9/1997 | Ernstoff et al. |
| 5,723,950 | A | 3/1998 | Wei et al. |
| 5,844,540 | A | 12/1998 | Terasaki |
| 5,898,329 | A | 4/1999 | Hopkins |
| 6,281,822 | B1 | 8/2001 | Park |
| 6,864,641 | B2 | 3/2005 | Dygert |
| 6,937,084 | B2 | 8/2005 | Bowling |
| 6,943,500 | B2 | 9/2005 | LeChevalier |
| 6,995,592 | B2 | 2/2006 | Agarwal |
| 7,106,294 | B2 | 9/2006 | Kumamoto et al. |
| 7,126,397 | B1 | 10/2006 | Mok |
| 7,176,948 | B2 | 2/2007 | Lewis |
| 7,262,724 | B2 | 8/2007 | Hughes et al. |

(Continued)

FOREIGN PATENT DOCUMENTS

JP 2003332624 A 11/2003

(Continued)

OTHER PUBLICATIONS

Notice of Allowance mailed Dec. 29, 2011 for U.S. Appl. No. 12/703,249, 24 pages.

(Continued)

*Primary Examiner* — Tuyet Thi Vo

(57) ABSTRACT

A pulse width modulation (PWM) signal generator generates multiple output PWM signals from an input PWM signal. The output PWM signals are synchronized to synchronization events. Each output PWM signal has a duty ratio substantially equal to the duty ratio of the input PWM signal, and each output PWM signal has a fixed phase-shift in relation to the other output PWM signals. The PWM signal generator samples an input PWM cycle to determine sample parameters representative of its duty ratio. The sample parameters are then used to generate a corresponding output PWM cycle for each of the output PWM signals. In response to a synchronization event, the PWM signal generator prematurely terminates the current PWM cycle and initiates the next PWM cycle while ensuring that the portion of the current output PWM cycle completed by the leading output PWM signal up to the point of the premature termination is replicated for the corresponding output PWM cycles of the other non-leading output PWM signals.

20 Claims, 9 Drawing Sheets

U.S. PATENT DOCUMENTS

| | | | |
|---|---|---|---|
| 7,391,280 | B2 | 6/2008 | Hsu |
| 7,436,378 | B2 | 10/2008 | Ito et al. |
| 7,511,545 | B1 | 3/2009 | Kesler |
| 7,550,932 | B2 | 6/2009 | Kung et al. |
| 7,593,243 | B2 | 9/2009 | Ganev et al. |
| 7,741,885 | B1 | 6/2010 | Guo et al. |
| 7,800,415 | B2 | 9/2010 | Yedevelly et al. |
| 2004/0008159 | A1 | 1/2004 | Cunha et al. |
| 2004/0208011 | A1 | 10/2004 | Horiuchi et al. |
| 2004/0232964 | A1 | 11/2004 | Wiktor et al. |
| 2004/0233144 | A1 | 11/2004 | Rader et al. |
| 2004/0251942 | A1 | 12/2004 | Chiu et al. |
| 2005/0275355 | A1 | 12/2005 | Samuelsson |
| 2006/0064609 | A1 | 3/2006 | Bryan |
| 2006/0164142 | A1 | 7/2006 | Stanley |
| 2006/0186830 | A1 | 8/2006 | Shami et al. |
| 2007/0080911 | A1 | 4/2007 | Liu et al. |
| 2007/0182701 | A1 | 8/2007 | Kim et al. |
| 2007/0253330 | A1 | 11/2007 | Tochio et al. |
| 2008/0054815 | A1 | 3/2008 | Kotikalapoodi |
| 2008/0074381 | A1 | 3/2008 | Kumamoto |
| 2008/0297067 | A1 | 12/2008 | Wang et al. |
| 2009/0073735 | A1 | 3/2009 | Kesler |
| 2009/0128045 | A1 | 5/2009 | Szczeszynski et al. |
| 2009/0187925 | A1 | 7/2009 | Hu et al. |
| 2009/0230874 | A1 | 9/2009 | Zhao et al. |
| 2009/0230891 | A1 | 9/2009 | Zhao et al. |
| 2009/0273288 | A1 | 11/2009 | Zhao et al. |
| 2009/0315481 | A1 | 12/2009 | Zhao |
| 2010/0026203 | A1 | 2/2010 | Zhao et al. |
| 2010/0085295 | A1 | 4/2010 | Zhao et al. |

FOREIGN PATENT DOCUMENTS

| | | | |
|---|---|---|---|
| JP | 2005116199 | A | 4/2005 |
| WO | 2008124718 | A2 | 10/2008 |

OTHER PUBLICATIONS

U.S. Appl. No. 13/025,201, filed Feb. 11, 2011 entitled, "Phase-Shifted Pulse Width Modulation Signal Generation Device and Method Therefor".

Mc Nerney, Tim, "constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.

Maxim: "Application Note 810, Understanding Flash ADCs," Oct. 2, 2001, 8 pages.

National Semiconductor Data Sheet: "LM3432/LM3432B 6-Channel Current Regulator for LED Backlight Application," May 22, 2008, pp. 1-18.

U.S. Appl. No. 12/537,443, filed Aug. 7, 2009, entitled Pulse Width Modulation Frequency Conversion.

U.S. Appl. No. 12/703,239, filed Feb. 10, 2010, entitled "Pulse Width Modulation With Effective High Duty Resolution".

U.S. Appl. No. 12/537,692, filed Aug. 7, 2009, entitled "Phase-Shifted Pulse Width Modulation Signal Generation".

International Application No. PCT/US2009/035284, Search Report and Written Opinion, Oct. 28, 2009, 11 pages.

U.S. Appl. No. 12/703,249, filed Feb. 10, 2010, entitled "Duty Transition Control in Pulse Width Modulation Signaling".

Luke Huiyong Chung, Electronic Products: "Driver ICs for LED BLUs," May 1, 2008, 3 pages.

Akira Takahashi, Electronic Products: "Methods and features of LED drivers," Mar. 2008, 3 pages.

U.S. Appl. No. 12/340,985, filed Dec. 22, 2008, entitled "LED Driver With Feedback Calibration".

U.S. Appl. No. 12/326,963, filed Dec. 3, 2008, entitled "LED Driver With Precharge and Track/Hold".

U.S. Appl. No. 12/367,672, filed Feb. 9, 2009, entitled " Configuration for Dynamic Power Control in LED Displays".

U.S. Appl. No. 12/424,326, filed Apr. 15, 2009, entitled "Peak Detection With Digital Conversion".

U.S. Appl. No. 12/504,841, filed Jul. 17, 2009, entitled "Analog-To-Digital Converter With Non-Uniform Accuracy".

U.S. Appl. No. 12/690,972, filed Jan. 21, 2010, entitled "Serial Cascade of Minimum Tail Voltages of Subsets of LED Strings for Dynamic Power Contrl in LED Displays".

U.S. Appl. No. 12/363,607, filed Jan. 30, 2009, entitled "LED Driver With Dynamic Headroom Control".

Texas Instruments Publication, "Interleaved Dual PWM Controller with Programmable Max Duty Cycle," SLUS544A, (UCC28220, UCC28221) Sep. 2003, pp. 1-28.

Notice of Allowance mailed Oct. 5, 2010 for U.S. Appl. No. 12/537,692, 13 pages.

Non-Final Office Action mailed Oct. 20, 2011 for U.S. Appl. No. 12/537,443, 22 pages.

PCT Search Report mailed Mar. 28, 2011 for International Application No. PCT/US2010/044067, 3 pages.

Feng et al., "A New Switched-Capacitor Frequency Modulated Driver for Light Emitting Diodes," Review of Scientific Instruments 78, 114710, American Institute of Physics, 2007, 4 pages.

Tadakuma, S. et al., "Improved PWM Control for GTO Inverters with Pulse Number Modulation," IEEE Transactions on Industry Applications, vol. 32, No. 3. Jun. 1, 1996, 7 pages.

Non-final Office Action mailed May 9, 2012 for U.S. Appl. No. 12/244,796, 36 pages.

Notice of Allowance mailed Jan. 25, 2012 for U.S. Appl. No. 12/537,443, 18 pages.

FOR PWM SIGNAL GENERATOR X (X = A, B, C)

SYNCHRONIZED PHASE-SHIFTED PULSE WIDTH MODULATION SIGNAL GENERATION

CROSS-REFERENCE TO RELATED APPLICATIONS

The present application is related to U.S. patent application Ser. No. 12/537,692 filed on Aug. 7, 2009 and entitled "Phase-Shifted Pulse Width Modulation Signal Generation."

FIELD OF THE DISCLOSURE

The present disclosure relates generally to pulse width modulation (PWM) and more particularly to the parallel generation of multiple phase-shifted PWM signals.

BACKGROUND

Pulse width modulation (PWM) signals often are used for precise control of electronic devices, such as electric motors, light emitting diode (LED) backlights, and the like. In some systems, an input PWM signal is used to generate multiple PWM signals in parallel, and the multiple PWM signals are then used to drive one or more respective components. In generating multiple output PWM signals, it often is advantageous to synchronize the output PWM signals with the input PWM signal. To illustrate, in display systems implementing LEDs controlled by the output PWM signals, the input PWM signal often is synchronized with the display frame frequency, so a lack of synchronization between the output PWM signals and the input PWM signal can result in visual noise due to beating between the display frame frequency, the output PWM frequency, and their harmonics. Further, it can be advantageous to phase-shift the parallel output PWM signals in relation to each other to avoid or reduce undesirable effects, such as increased electromagnetic interference (EMI), large ripple in the power supply voltage when the components driven by the multiple PWM signals share the same power supply, and audible noise when the output PWM signals have a frequency in the human audible range.

For video-based systems, one conventional approach involves the direct use of the input PWM signal to drive multiple parallel strings of LEDs of a display in instances whereby the input PWM signal is synchronized to the frame rate of the display. However, the input PWM signal typically has a relatively low frequency and this approach therefore often has a number of undesirable ramifications, such as the introduction of audible noise and relatively large voltage ripple in the voltage supply, and increased power consumption. In other conventional systems, a frequency converter is used to convert the input PWM signal to a higher-frequency PWM signal that is then used to directly drive the parallel LED strings. However, this approach often results in the loss of synchronization between the PWM signal and the frame rate and thus is susceptible to visual noise issues, such beating between the frame rate, the frequency of the converted PWM signal, and their harmonics. Accordingly, other conventional approaches have sought to avoid these issues through the use of a phase-locked loop (PLL). However, the frequency of the input PWM signal and the frame rate often can be relatively low, thus requiring the use of a PLL with a low reference frequency and a small loop bandwidth. Such PLLs typically have a long locking time and require a relatively large area for implementation, thereby adding considerable cost and complexity to any design implementing a PLL-based solution.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
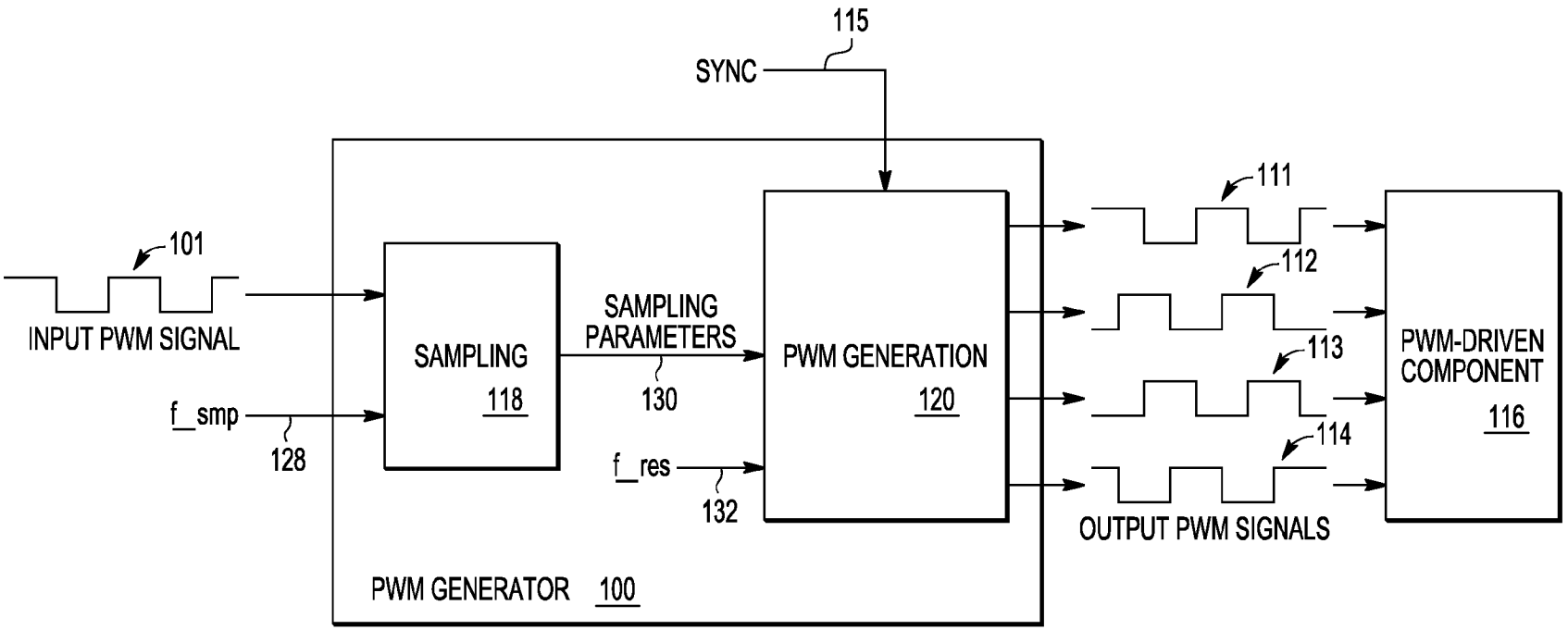
FIG. 1 is a diagram illustrating a pulse width modulation (PWM) signal generator in accordance with at least one embodiment of the present invention.

FIGS. 1-9 illustrate a pulse width modulation (PWM) signal generator for generating multiple output PWM signals from an input PWM signal, whereby the multiple output PWM signals are synchronized to frame synchronization signals or other synchronization events and whereby each output PWM signal has a duty ratio substantially equal to the duty ratio of the input PWM signal and each output PWM signal has a fixed phase-shift in relation to the other output PWM signals. In one embodiment, the PWM signal generator samples an input PWM cycle of the input PWM signal to determine one or more sample parameters representative of the duty ratio of the sampled input PWM cycle. The PWM signal generator then uses the one or more sample parameters to generate a corresponding output PWM cycle for each of the output PWM signals. Further, in response to a synchronization event during generation of the output PWM cycle, the PWM signal generator is configured to prematurely terminate the current PWM cycle and initiate the next PWM cycle while ensuring that the portion of the current PWM cycle completed by the leading output PWM signal (i.e., the output PWM signal with the smallest phase shift) up to the point of the premature termination is replicated for the corresponding PWM cycles of the other non-leading output PWM signals. This process of sampling an input PWM cycle of the input PWM signal and generating a corresponding output PWM cycle for each of the output PWM signals based on the sample parameters resulting from the sampling process can be repeated for one or more iterations.

In order to provide output PWM signals more closely synchronized to a frame signal or other synchronization event, as well as to ensure the fixed phase shifts between the output PWM signals and duty ratio matching between the output PWM signals, in one embodiment the PWM signal generator implements three signal generation units in parallel to generate corresponding sets of intermediate PWM signals, particular subsets of which are then combined together to generate the corresponding output PWM signals. Each signal generation unit uses a separate counter to time the generation of active segments (i.e., the portions of PWM cycles that are pulled "high" or to logic "1") for the corresponding intermediate PWM signals, and each signal generation unit is controlled in part based on the operations of the other signal generation units and based on the timing of synchronization events. In this manner, the PWM signal generator is able to generate parallel phase-shifted output PWM signals synchronized to synchronization events and having duty ratios substantially equal to the duty ratio of the input PWM signal, and thus fully adhering to synchronization and phase-shift requirements without requiring the use of a phase-locked loop (PLL) or other similarly complex component. In video-based implementations, this synchronization between the frame rate and the phase-shifted output PWM signals reduces or eliminates certain visual noise effects, such as beating that occurs when the PWM signals driving LED strings of a display are out-of-sync with the frame rate of the display.

The term "leading PWM signal" and its variants refer to the PWM signal of an identified set that has the lowest (or zero) phase shift relative to the other PWM signals of the identified set. The term "non-leading PWM signal" and its variants therefore refer to the PWM signals of the identified set other than the leading PWM signal of the identified set. The term "active segment" refers to that portion of a PWM signal that is pulled "high" or pulled to logic "1." The term "inactive segment" refers to that portion of a PWM signal that is pulled "low" or pulled to logic "0."

FIG. 1 illustrates a PWM signal generator 100 in accordance with at least one embodiment of the present disclosure. The PWM signal generator 100 receives an input PWM signal 101 and from this signal generates a plurality of output PWM signals (e.g., output PWM signals 111, 112, 113, and 114), whereby each output PWM signal has a fixed phase shift relative to the other output PWM signals and is synchronized to synchronization events indicated via a synchronization (SYNC) signal 115. The plurality of output PWM signals then may be used to drive or otherwise control operations of one or more PWM-driven components 116. The PWM-driven component 116 can include, for example, light emitting diodes (LEDs) of a LED-based display or an electronic motor. The input PWM signal 101 is generated by a PWM source (not shown), which can include, for example, a video processor for a context whereby the input PWM signal 101 is a backlight control signal, a microcontroller for a context whereby the input PWM signal 101 is a motor control signal, etc. In this instance, the SYNC signal 115 can include, for example, a frame rate signal or a vertical synchronization (VSYNC) signal in a video application context. Accordingly, for purposes of the following description, assertions of the SYNC signal 115 (indicating the frame timing) serve as synchronization events to which the PWM signal generator 100 is synchronized. Although FIG. 1 illustrates an example implementation whereby four output PWM signals are generated, the techniques described herein can be used to generate any number of parallel, phase-shifted output PWM signals having substantially equal duty ratios.

In the illustrated embodiment, the PWM signal generator 100 includes a sampling module 118 and a PWM generation module 120. The functionality of the various modules of the PWM signal generator 100 as illustrated in FIGS. 1-9 can be implemented as hardware, firmware, one or more processors that execute software representative of the corresponding functionality, or a combination thereof. To illustrate, the functionality of certain components can be implemented as discrete logic, an application specific integrated circuit (ASIC) device, a field programmable gate array (FPGA), and the like.

The sampling module 118 is configured to sample the input PWM signal 101 using a sample clock signal 128 (having a frequency f_smp) to generate sample parameters 130 for each iteration of the sampling process. The sample parameters 130 determined by the sampling module 118 can include a value N_t that represents the total number of samples taken over an input PWM cycle being sampled and a value N_h that represents the number of samples taken over the sampled PWM cycle that have a select sample value (e.g., logic "1" or "high" for this example). Thus, the ratio of the value N_h (a measure of the duration of the active segment of the sampled PWM cycle) to the value N_t (a measure of the total duration, or period, of the sampled PWM cycle) represents the duty ratio of the sampled PWM cycle. From the value N_h and N_t for a sampled PWM cycle, the sampling module 118 can determine a value Npwm as Npwm=(N_h/N_t) * n_pwm, whereby n_pwm is the PWM code range of the PWM generation module 120. To illustrate, for an eight-bit PWM code range (8b), n_pwm has a value of 255 (2^8−1), and for a ten-bit PWM code range (10b), n_pwm has a value of 1023 (2^10−1). As described in greater detail herein, the value n_pwm is used by the PWM generation module 120 to time the duration of an output PWM cycle based on the frequency f res of a PWM timing signal 132.

In one embodiment, the sampling module 118 updates the sample parameters 130 for each successive input PWM cycle of the input PWM signal 101 or for each Xth PWM cycle of the input PWM signal 101 (i.e., by performing the sampling process each successive PWM cycle or for each Xth PWM cycle). Alternatively, the values for N_h and N_t (and thus the resulting value for Npwm) determined from one input PWM cycle then can be used for generation of output PWM cycles for the output PWM signals 111-114 until a certain event, such as the expiration of a timer, the generation of an interrupt, or a power-on reset. Further, because jitter and other noise in the input PWM signal 101 or the sampling signal 128 may introduce improper variation in the resulting sample parameters 130 from sampled PWM cycle to sampled PWM cycle, a noise filtering technique may be applied to the resulting sample parameters 130 to reduce or minimize the effect of this noise during the sampling process. An example noise filtering technique well suited for the sampling process of the sampling module 118 is described in U.S. patent application Ser. No. 12/537,443, entitled "Pulse Width Modulation Frequency Conversion" and filed on Aug. 7, 2009.

The PWM generation module 120 receives the sample parameters 130, the SYNC signal 115, and the PWM timing signal 132 having a frequency f_res. From these inputs, the PWM generation module 120 generates the output PWM signals 111-114 such that each output PWM signal has a duty ratio that matches the duty ratio of the input PWM signal 101 and further such that each output PWM signal has a fixed phase shift or delay relative to the other output PWM signals. Further, the PWM generation module 120 is configured to synchronize the generation of the output PWM signals 111-114 to the SYNC signal 115 such that an assertion of the SYNC signal 115 causes the PWM generation module 120 to prematurely terminate generation of the current output PWM cycle of the leading output PWM signal (output PWM signal 111) and initiate generation of the next output PWM cycle of the leading output PWM signal, with similar changes affecting the non-leading output PWM signals (output PWM signals 112-114). Further, in order to ensure that the effective PWM duty ratio of each output PWM signal is the same for a given output PWM cycle, the PWM generation module 120 is configured to replicate that part of the current PWM cycle of the leading output PWM signal 111 for each of the non-leading output PWM signals 112-114, as described in greater detail herein.

Figure 2:
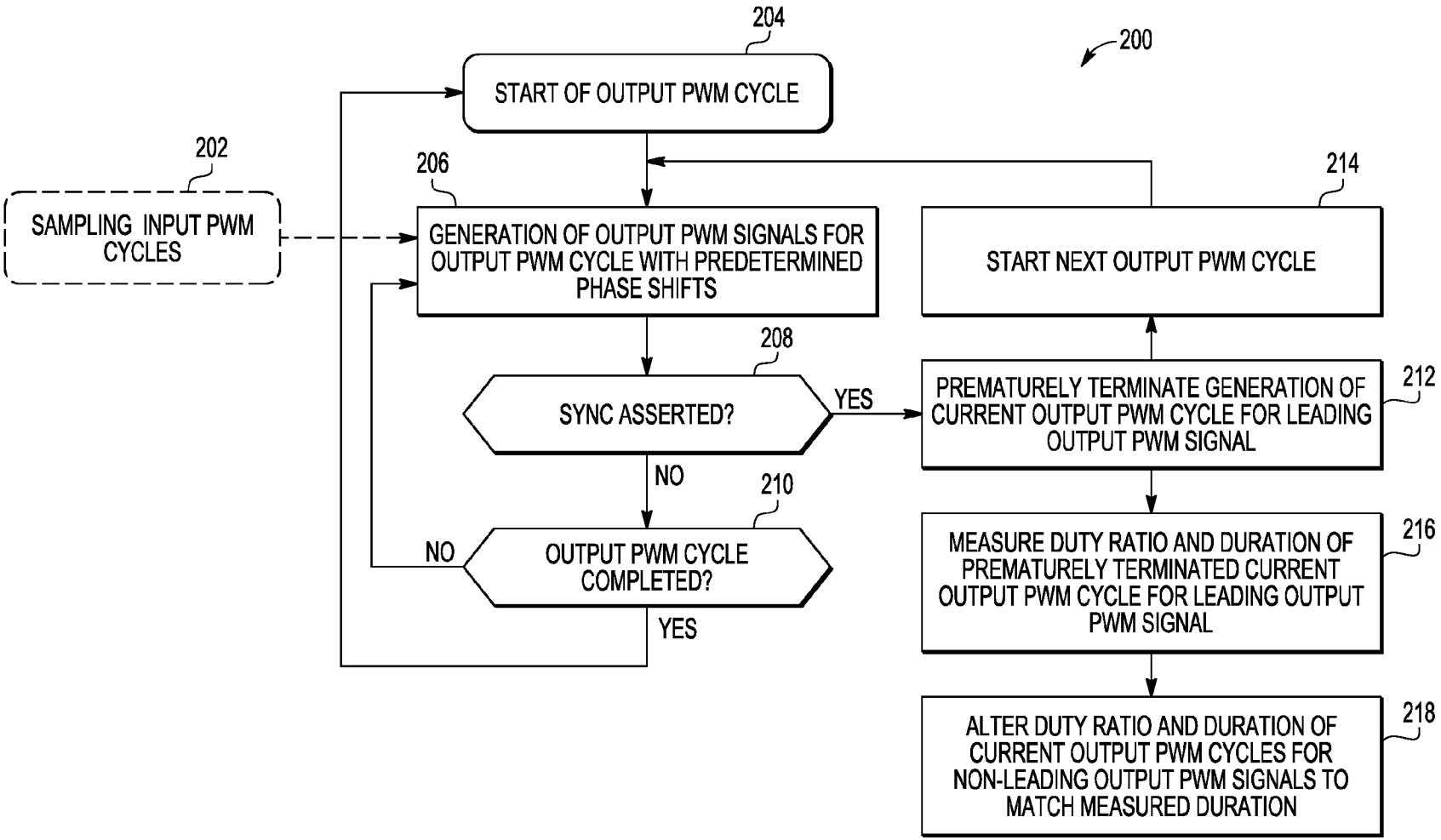
FIG. 2 is a flow diagram illustrating an example method of operation of the PWM signal generator of FIG. 1 in accordance with at least one embodiment of the present invention.

FIG. 2 illustrates an example method 200 of operation of the PWM signal generator 100 of FIG. 1 in accordance with at least one embodiment of the present disclosure. At block 202, the sampling module 118 samples input PWM cycles of the input PWM signal 101 to determine one or more sample parameters 130 representative of the sampled input PWM cycle, such as the value Npwm which represents the duty ratio of the sampled input PWM cycle. As described above, the sampling module 118 can refresh the sample parameters 130 with each input PWM cycle or with every Xth input PWM cycle, or the sampling module 118 can refresh the sample parameters 130 in response to a stimulus event, such as expiration of a timer or generation of an interrupt.

In parallel with the sampling process, the PWM generation module 120 generates the output PWM signals 111-114 based on the current sample parameters 130. Block 204 represents the start of the next output PWM cycle to be generated for each of the output PWM signals 111-114. In response, at block 206 the PWM generation module 120 initiates generation of corresponding active segments of the output PWM signals 111-114 such that the output PWM cycle for each successive output PWM signal is phase-shifted by a predetermined amount from the succeeding output PWM signal. The relative phase-shift of each output PWM signal may be the same for each output PWM signal or different for one or more of the output PWM signals. While generating the output PWM cycles of the output PWM signals 111-114, the PWM generation module 120 monitors the SYNC signal 115 at block 208 to sense whether the SYNC signal 115 has been asserted (that is, whether a synchronization event has occurred). In the event the SYNC signal 115 is not asserted, the PWM generation module 120 continues to generate the output PWM cycle for the output PWM signals until the output PWM cycle is completed (as determined at block 210) and this process is repeated at block 204 for the next output PWM cycle. In the event that the SYNC signal 115 is asserted during the generation of the output PWM cycle, at block 212 the PWM generation module 120 prematurely terminates generation of the current output PWM cycle for the leading output PWM signal 111 and at block 214 the PWM generation module 120 initiates generation of the next output PWM cycle, starting with the leading output PWM signal 111.

Due to the phase-shifts between the output PWM signals 111-114, the premature termination of the output PWM cycle in response to an assertion of the SYNC signal 115 can lead to unequal duty ratios between the output PWM signals 111-114. To compensate, in one embodiment the portion of the current output PWM cycle completed for the leading output PWM signal 111 before being prematurely terminated by the assertion of the SYNC signal 115 is replicated for each of the non-leading output PWM signals 112-114 so as to maintain equivalent duty ratios among the output PWM signals 111-114. To achieve this process, at block 216 the PWM generation module 120 measures the completed portion of the prematurely-terminated output PWM cycle for the leading output PWM signal 111 (that is, the duty ratio and duration of the output PWM cycle of the leading output PWM signal 111 generated before being prematurely terminated by the assertion of the SYNC signal 115). At block 218 the PWM generation module 120 uses this measured duty ratio and duration to alter the duty ratios and durations of the output PWM cycle for the non-leading output PWM signals 112-114 so as to match the leading output PWM cycle 111.

Figure 3:
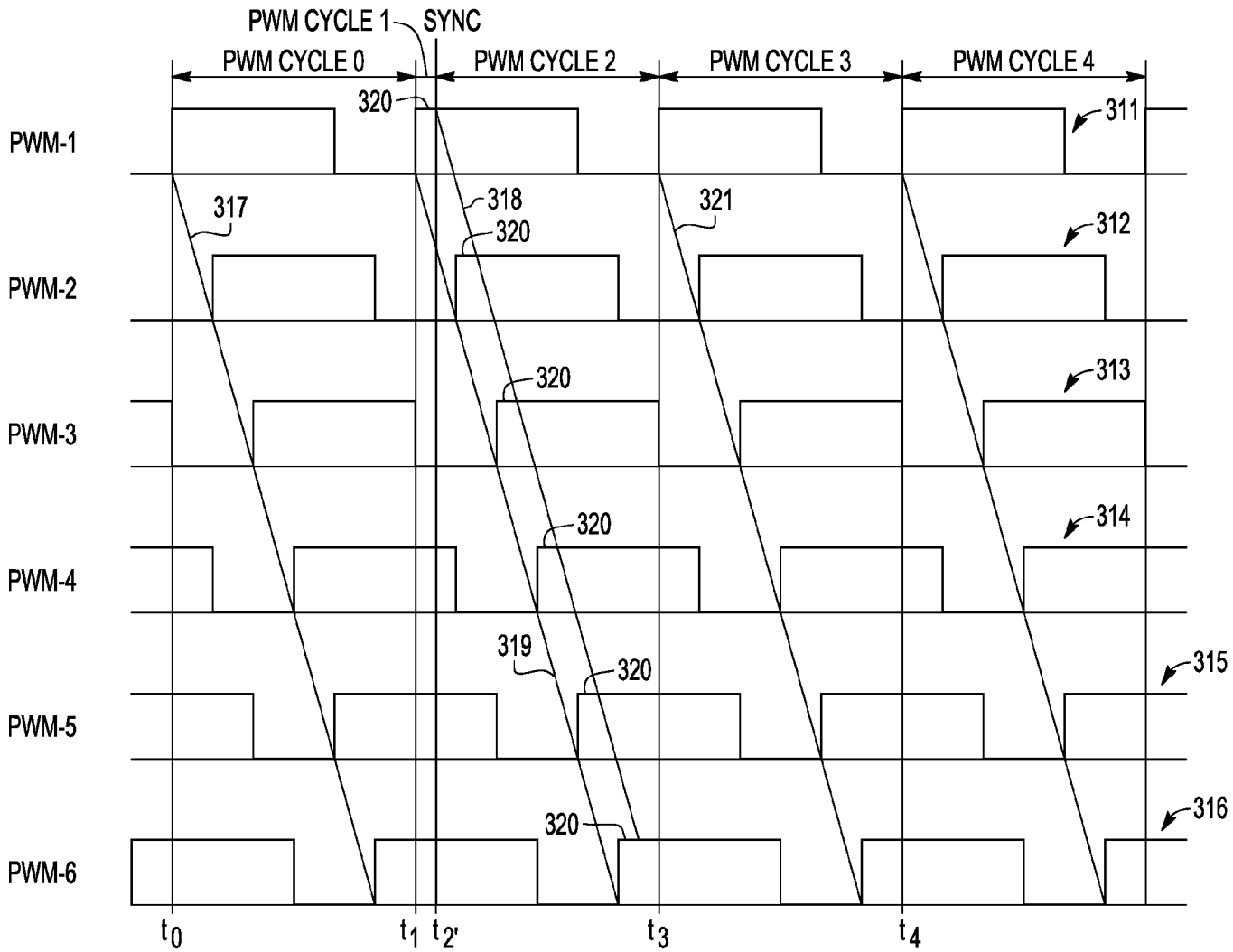
FIG. 3 is a timing diagram illustrating an example operation of the PWM signal generator of FIG. 1 in accordance with at least one embodiment of the present invention.

FIG. 3 depicts a timing diagram 300 illustrating an example of the compensation process used to maintain substantially equal duty ratios among output PWM signals in the event of premature termination of an output PWM cycle due to a synchronization event. In the example of FIG. 3, six parallel output PWM signals, represented by lines 311-316, are generated in accordance with the principles described herein. The output PWM signal PWM-1 (represented by line 311) has a phase shift of zero and thus is the leading output PWM signal, and each of the output PWM signals PWM-2 to PWM-6 (represented by lines 312-316, respectively) is phase-shifted by a value $t_{ps}$ relative to the preceding output PWM signal. At time $t_0$, an output PWM cycle 0 starts and thus the PWM generation module 120 initiates generation of the active segment of the output PWM signal PWM-1 for the output PWM cycle 0. The PWM generation module 120 initiates generation of the active segments of the output PWM signals PWM-2 to PWM-6 for the output PWM cycle at times $t_0+t_{ps}$, $t_0+2t_{ps}$, $t_0+3t_{ps}$, $t_0+4t_{ps}$, and $t_0+5t_{ps}$, respectively. Line 317 represents this equal relative phase-shift between the output PWM signals starting from time $t_0$. At time $t_1$, the output PWM cycle 0 ends for the leading output PWM signal PWM-1 and an output PWM cycle 1 begins. Accordingly, as with the output PWM cycle 0, the PWM generation module 120 initiates generation of the active segment of the output PWM signal PWM-1 at time $t_1$. However, at time $t_{2'}$ the SYNC signal 115 is asserted, thereby prematurely terminating the output PWM cycle 1 for the leading output PWM signal PWM-1 at time $t_{2'}$ and initiating the start of the next output PWM cycle 2, whereby the PWM generation module 120 initiates generation of the active segments of the output PWM signals PWM-1 to PWM-6 in the manner described above. The line 318 represents the equal phase-shift between the output PWM signals starting from time $t_{2'}$. At time $t_3$, the output PWM cycle 2 ends for the leading output PWM signal PWM-1 and thus the PWM generation module 120 initiates an output PWM cycle 3 in the same manner as described above for the output PWM cycle 0. This same process is repeated for output PWM cycle 4 starting at time $t_4$, and so on.

The premature termination of the output PWM cycle 1 for the leading output PWM signal PWM-1 results in a completed portion 320 in the leading output PWM signal PWM-1. In order to ensure that the average duty ratio of each output PWM cycle is substantially equal for the time window represented by timing diagram 300, the PWM generation module 120 duplicates the completed portion 320 for each of the non-leading output PWM signals PWM-2 to PWM-6 starting from the appropriate phase-shifted times (represented by line 319) so that the effective duty ratio for each of the output PWM signals PWM-1 to PWM-6 is substantially equal for the duration between the start of the output PWM cycle 1 (represented by line 319) and the end of the output PWM cycle 2 (represented by line 321). By ensuring that the duty ratio and duration of any prematurely-terminated output PWM cycle in the leading output PWM signal is equally replicated in the non-leading output PWM signals, the duty ratios of the output PWM signals can be maintained as substantially equal, thereby reducing or avoiding issues arising from imbalance in the duty ratios between parallel output PWM signals, such as image distortion in display applications.

Figure 4:
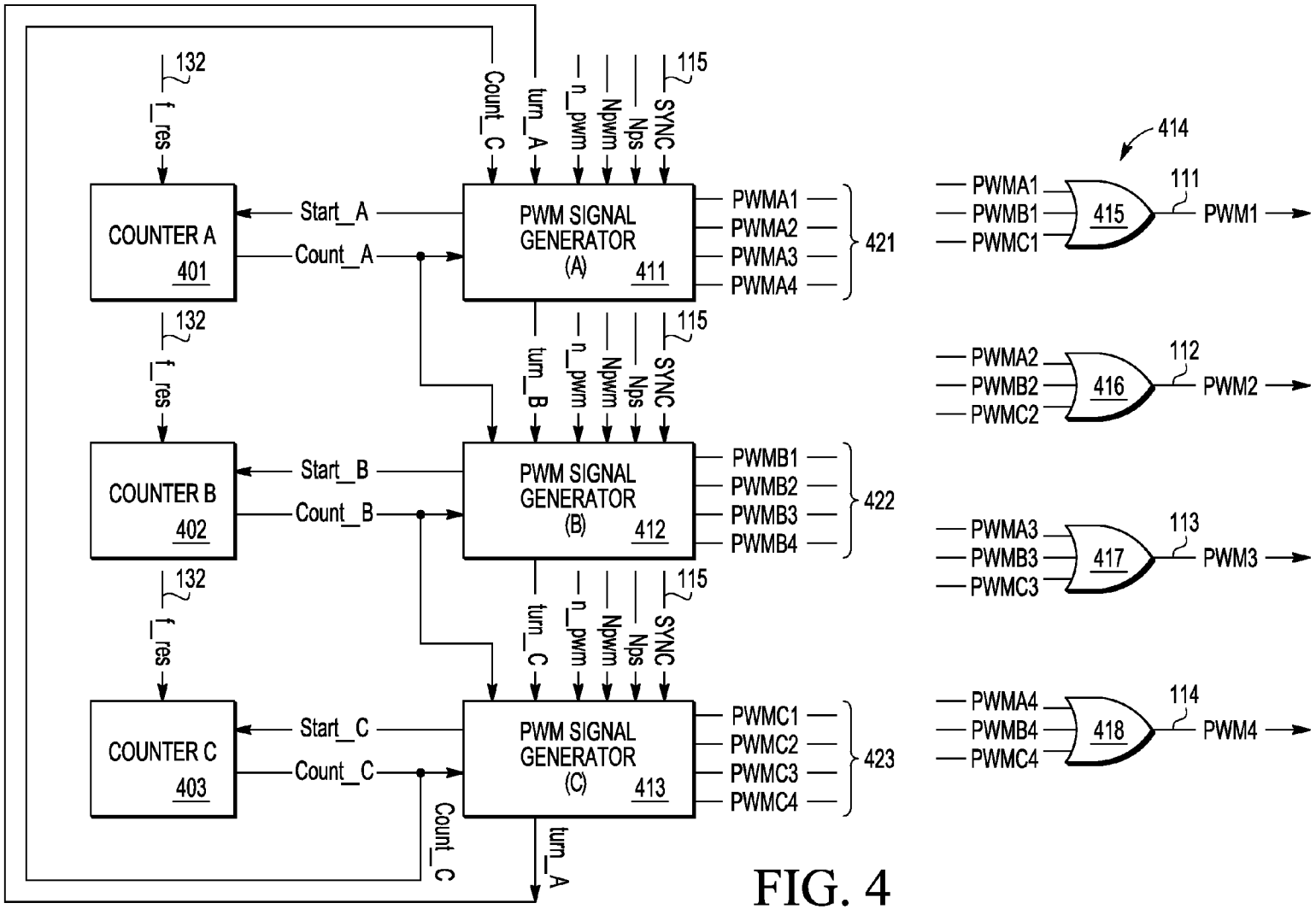
FIG. 4 is a diagram illustrating an implementation of a PWM generation module of the PWM signal generator of FIG. 1 in accordance with at least one embodiment of the present invention.

FIG. 4 illustrates an example implementation of the PWM generation module 120 of FIG. 1 in accordance with at least one embodiment of the present disclosure. In the depicted example, the PWM generation module 120 includes three counters 401, 402, and 403 (also identified as counters A, B, and C, respectively), three signal generation units 411, 412, and 413, and a signal combination module 414 for combining the signals output by the three signal generation units 411-413 in the manner described below. As illustrated, the signal combination module 414 can be implemented as four OR gates 415, 416, 417, and 418.

The counter 401 has an input to receive the PWM timing signal 132, an input to receive a start signal Start_A, and an output to provide a count value Count_A, whereby the counter 401 resets the count value Count_A and begins counting clock cycles of the PWM timing signal 132 in response to an assertion of the start signal Start_A. Likewise, the counter 402 provides a count value Count_B, whereby the counter 402 resets the count value Count_B and begins counting clock cycles of the PWM timing signal 132 in response to an assertion of a start signal Start_B. The counter 403 operates in the same manner for a count value Count_C responsive to an assertion of a start signal Start_C.

The PWM signal generation unit 411 includes inputs to receive the count value Count_A from the counter 401; the count value Count_C from the counter 403; a toggle signal turn_A from the signal generation unit 413; the SYNC signal 115; the current value of Npwm from the sampling module 118; the value n_pwm representative of the duration of the output PWM signal to be generated (measured in cycles of the PWM timing signal 132); and the value Nps representing the phase shift $t_{ps}$ to be implemented between each successive output PWM signal. In other embodiments, the phase shifts may not be equal, and thus the PWM signal generation unit 411 may receive a separate phase-shift value for each phase shift to be implemented. The PWM signal generation unit 411 includes outputs to provide the Start_A signal; a toggle signal turn_B; and a set 421 of intermediate PWM signals PWMA1, PWMA2, PWMA3, and PWMA4. The PWM signal generation unit 412 includes inputs to receive the count value Count_B from the counter 402; the count value Count_A from the counter 401; the toggle signal turn_B from the signal generation unit 411; the SYNC signal 115; the current value of Npwm from the sampling module 118; the value n_pwm; and the value Nps. The PWM signal generation unit 412 includes outputs to provide the Start_B signal; a toggle signal turn_C; and a set 422 of intermediate PWM signals PWMB1, PWMB2, PWMB3, and PWMB4. The PWM signal generation unit 413 includes inputs to receive the count value Count_C from the counter 403; the count value Count_B from the counter 402; the toggle signal turn_C from the signal generation unit 412; the SYNC signal 115; the current value of Npwm; the value npwm; and the value Nps. The PWM signal generation unit 413 includes outputs to provide the Start_C signal; the toggle signal turn_A; and a set 423 of intermediate PWM signals PWMC1, PWMC2, PWMC3, and PWMC4.

The signal generation units 411-413 use the count values Count_A, Count_B, and Count_C, respectively, generated from counting clock cycles of the PWM timing signal 132 to time the generation the sets 421-423 of intermediate PWM signals using the values Npwm, npwm, and Nps as described below. The intermediate PWM signals of the sets 421-423 are combined by the OR gates 415-418 to generate the corresponding output PWM signals 111-114. In particular, the OR gate 415 combines the intermediate PWM signals PWMA1, PWMB1, and PWMC1 to generate the output PWM signal 111; the OR gate 416 combines the intermediate PWM signals PWMA2, PWMB2, and PWMC2 to generate the output PWM signal 112; the OR gate 417 combines the intermediate PWM signals PWMA3, PWMB3, and PWMC3 to generate the output PWM signal 113; and the OR gate 418 combines the intermediate PWM signals PWMA4, PWMB4, and PWMC4 to generate the output PWM signal 114.

As illustrated by FIG. 4, the signal generation units 411-413 are connected in a ring-like manner such that the signal generation unit 411 provides the toggle signal turn_B to the signal generation unit 412 (which also receives the count value Count_A used by the signal generation unit 411), the signal generation unit 412 provides the toggle signal turn_C to the signal generation unit 413 (which also receives the count value Count_B used by the signal generation unit 412), and the signal generation unit 413 provides the toggle signal turn_A to the signal generation unit 411 (which also receives the count value Count_C used by the signal generation unit 413). As such, the signal generation unit 412 is the next signal generation unit relative to the signal generation unit 411, the signal generation unit 413 is the next signal generation unit relative to the signal generation unit 412, and the signal generation unit 411 is the next signal generation unit relative to the signal generation unit 413. That is, the signal generation unit 412 is downstream of the signal generation unit 411 and upstream of the signal generation unit 413, the signal generation unit 413 is downstream of the signal generation unit 412 and upstream of the signal generation unit 411, and the signal generation unit 411 is downstream of the signal generation unit 413 and upstream of the signal generation unit 412.

Figure 5:
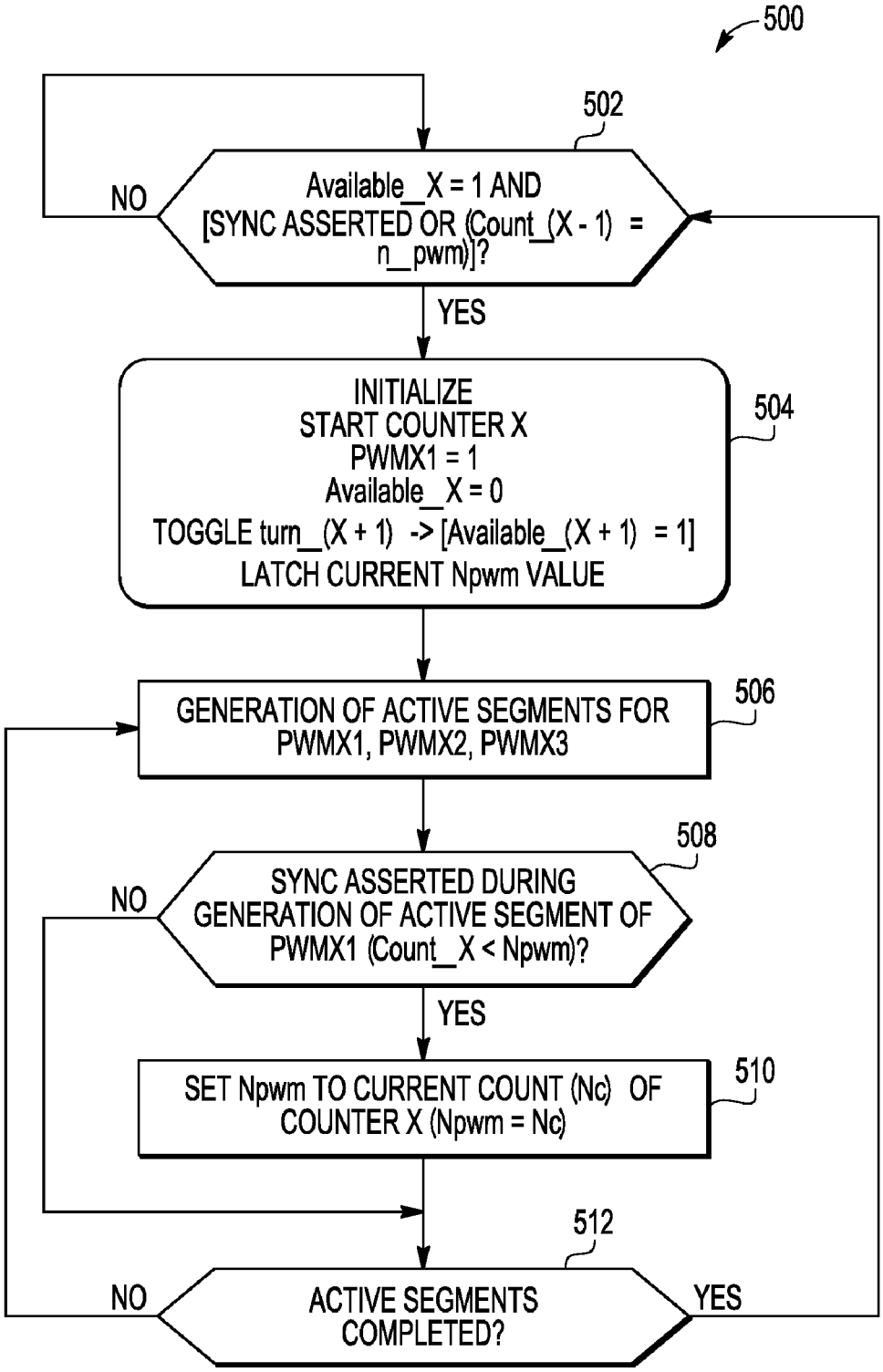
FIG. 5 is a flow diagram illustrating an example method of operation of the implementation of the PWM generation module of FIG. 4 in accordance with at least one embodiment of the present invention.

FIG. 5 illustrates a method 500 of operation of each of the signal generation units 411-413 (identified as signal generation unit X) in accordance with at least one embodiment of the present disclosure. In a general overview of the operation of the illustrated implementation of FIG. 4, each signal generation unit waits until the count value for the upstream signal generation unit has reached the value n_pwm (in the absence of an assertion of the SYNC signal 115), at which point the waiting signal generation unit initiates generation of its corresponding set of intermediate PWM signals. To this end, each signal generation unit X maintains a status flag (Available_X) indicating whether the signal generation unit is already in the process of generating a PWM cycle for its corresponding set of intermediate PWM signals, whereby a value of "1" indicates the signal generation unit X is available and a value of "0" indicates the signal generation unit X is unavailable. The value of the Available_X status flag is toggled in response to an assertion of the turn_X signal from the upstream signal generation unit. To illustrate, when the signal generation unit 411 asserts the toggle signal turn_B, the signal generation unit 412 toggles the value of its Available_B status flag in response. Accordingly, at block 502, the signal generation unit X monitors the Available_X status flag and other conditions to determine whether to initiate the generation of the next PWM cycle for the corresponding set of intermediate PWM signals. In particular, the signal generation unit X is configured to initiate the generation of the next PWM cycle when the Available_X status flag is set to available and one or both of the SYNC signal 115 has been asserted since the last PWM cycle or the count value of the upstream counter_(Count_(X−1)) has reached the value n_pwm (that is, the upstream counter has finished its corresponding leading PWM cycle for its set of intermediate PWM signals). In other words, the signal generation unit X proceeds with generation of the next output PWM cycle of the corresponding set of intermediate PWM signals when Available_X=1 AND [SYNC asserted OR Count_(X−1)=n_pwm]. In the event that these conditions are met, the signal generation unit X initializes at block 504.

The initialization of the signal generation unit X includes latching the current value of Npwm from the sampling module 118 and setting the Available_X status flag to "0", thereby identifying the signal generation unit X as unavailable. The initialization process also includes asserting the toggle signal turn_(X+1) so as to direct the downstream signal generation unit X+1 to toggle its Available_(X+1) status flag to "1", thereby identifying the downstream signal generation unit X+1 as available. To illustrate, when the signal generation unit 412 is initializing, the signal generation unit 412 asserts the turn_C signal so as to direct the signal generation unit 413 to toggle its Available_C status flag to "1" so as to indicate that the signal generation unit 413 is the next signal generation unit available to initiate generation of a corresponding PWM cycle (subject to the other conditions outlined above with respect to block 502). The initialization process further includes asserting the Start_X signal to reset and start the corresponding counter. To illustrate, during initialization the signal generation unit 411 asserts the Start_A signal to reset and start the counter 401.

After this initialization process, at block 506 the signal generation unit X begins generating the current PWM cycle for the corresponding set of intermediate PWM signals using the corresponding count value Count_X. In at least one embodiment, the signal generation unit X employs a plurality of comparators to time the generation of the active segments (that is, the portion of each intermediate PWM signal that is driven to a "1" or a "high" value during a PWM cycle) based on the count value Count_X, the value Npwm (representing the duty of the PWM cycle) and the value Nps (representing the relative phase shift from one PWM signal to the next). To illustrate, to generate a PWM cycle for the set 421 of intermediate PWM signals, the signal generation unit 411 drives the leading intermediate PWM signal PWMA1 high upon initialization and maintains the intermediate PWM signal PWMA1 high until the count value Count_A reaches Npwm (i.e., until Count_A=Npwm), at which point the intermediate PWM signal PWMA1 is pulled low. For non-leading PWM signals PWMA2-PWMA4, the signal generation unit 411 drives these signals high once the count value Count_A reaches Nps, 2 Nps, and 3 Nps, respectively, and then drives these signals low once the count value Count_A reaches Npwm+Nps, Npwm+2 Nps, and Npwm+3 Nps, respectively.

While the output PWM cycle for the intermediate PWM signals progresses, at block 508 the signal generation unit X monitors the SYNC signal 115 to determine whether the SYNC signal 115 has been asserted during the generation of the active segment for the leading intermediate PWM signal PWMX1 generated by the signal generation X. To make this determination in the event of an assertion of the SYNC signal 115, the signal generation unit X compares the count value Count X at the time of the assertion of the SYNC signal 115 with the value Npwm, which, as noted above, represents the duration of the active segments for the current output PWM cycle as measured in clock cycles of the PWM timing signal 132. In the event that the SYNC signal 115 is asserted after generation of the active segment of the leading intermediate PWM signal PWMX1 is complete (that is, Count_X>=Npwm), no adjustment is made to the operation of the signal generation unit X in response to this assertion of the SYNC signal 115. Note, however, that in this instance the assertion of the SYNC signal 115 after the generation of the active segment of the leading intermediate PWM signal PWMX1 will result in the initiation of the next PWM cycle using the downstream signal generation unit X+1 in the manner described above with respect to block 502.

In the event that the SYNC signal 115 is asserted during generation of the active segment of the leading intermediate PWM signal PWMX1 (that is, Count_X<Npwm), at block 510 the signal generation unit X prematurely terminates generation of the active segment of the leading intermediate PWM signal PWMX1 and latches the value of Count_X at the time of the assertion of the SYNC signal 115 as the count value Nc. The signal generation unit X then replaces its local copy of Npwm with the count value Nc (i.e., sets local Npwm=Nc) and then uses the new local value of Npwm in timing the generation of the active segments of the current PWM cycle for the non-leading PWM signals PWMX2-PWMX4 for the corresponding set. That is, when the SYNC signal 115 is asserted during generation of the active segment for the leading intermediate PWM signal PWMX1, the signal generation unit X prematurely terminates generation of the active segment for the leading intermediate PWM signal PWMX1 and similarly attenuates the following active segments for the non-leading PWM signals for the output PWM cycle that has been prematurely terminated while maintaining the predetermined phase shifts between each of the intermediate PWM signals.

At block 512 the signal generation unit X monitors the count value Count_X at to determine whether generation of the active segments of the intermediate PWM signals has completed. When the count value Count_X has reached Npwm+3 Nps, generation of the active segments for the current PWM cycle is complete and the signal generation unit X returns to block 502 to await generation of the next PWM cycle once the above-identified conditions have again been met.

Figure 6:
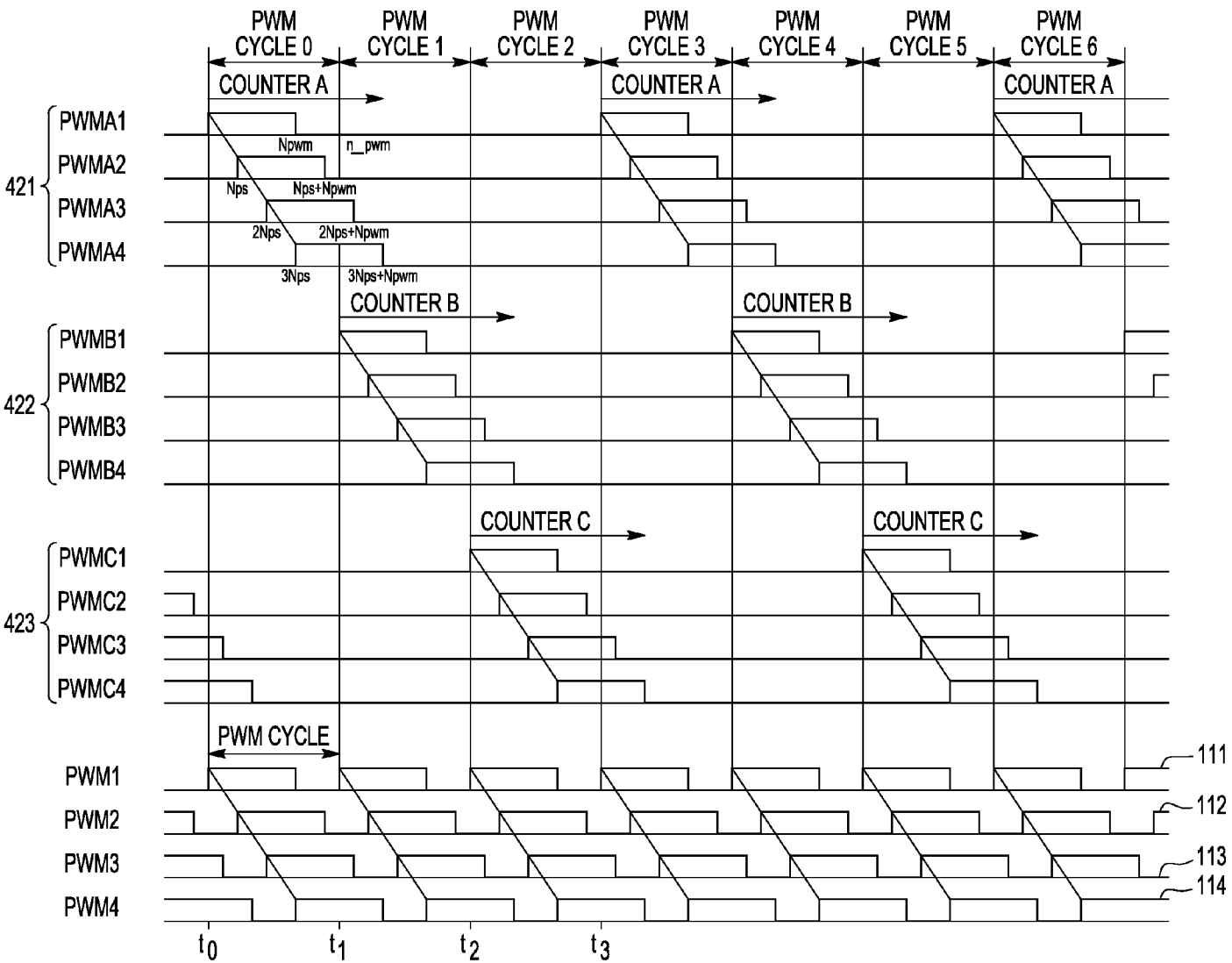
FIG. 6 is a timing diagram illustrating an example operation of the PWM generation module of FIG. 5 in the absence of a synchronization event in accordance with at least one embodiment of the present invention.
Figure 7:
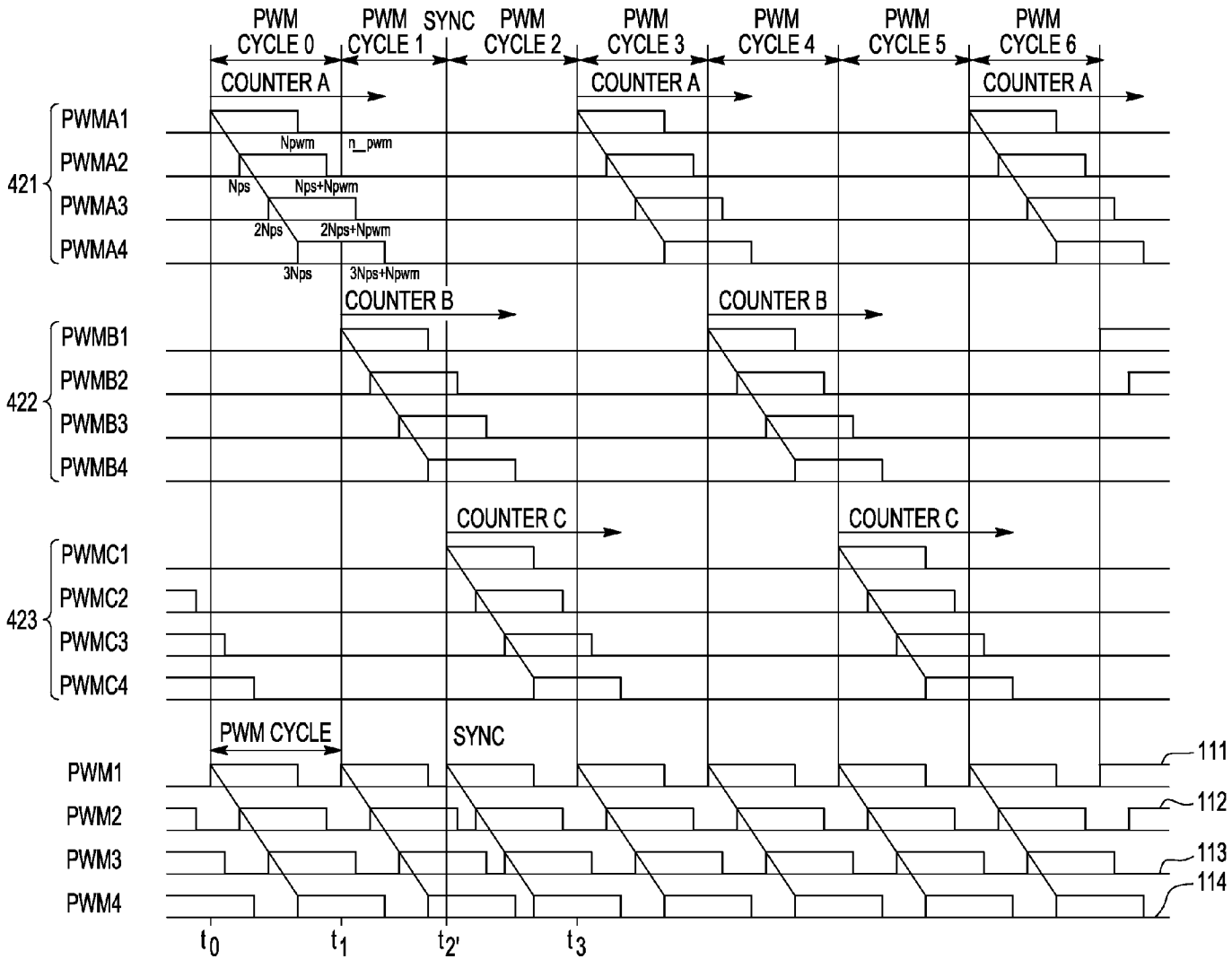
FIG. 7 is a timing diagram illustrating an example operation of the PWM generation module of FIG. 5 in the presence of a synchronization event occurring during a low segment of a PWM cycle of a leading output PWM signal in accordance with at least one embodiment of the present invention.
Figure 8:
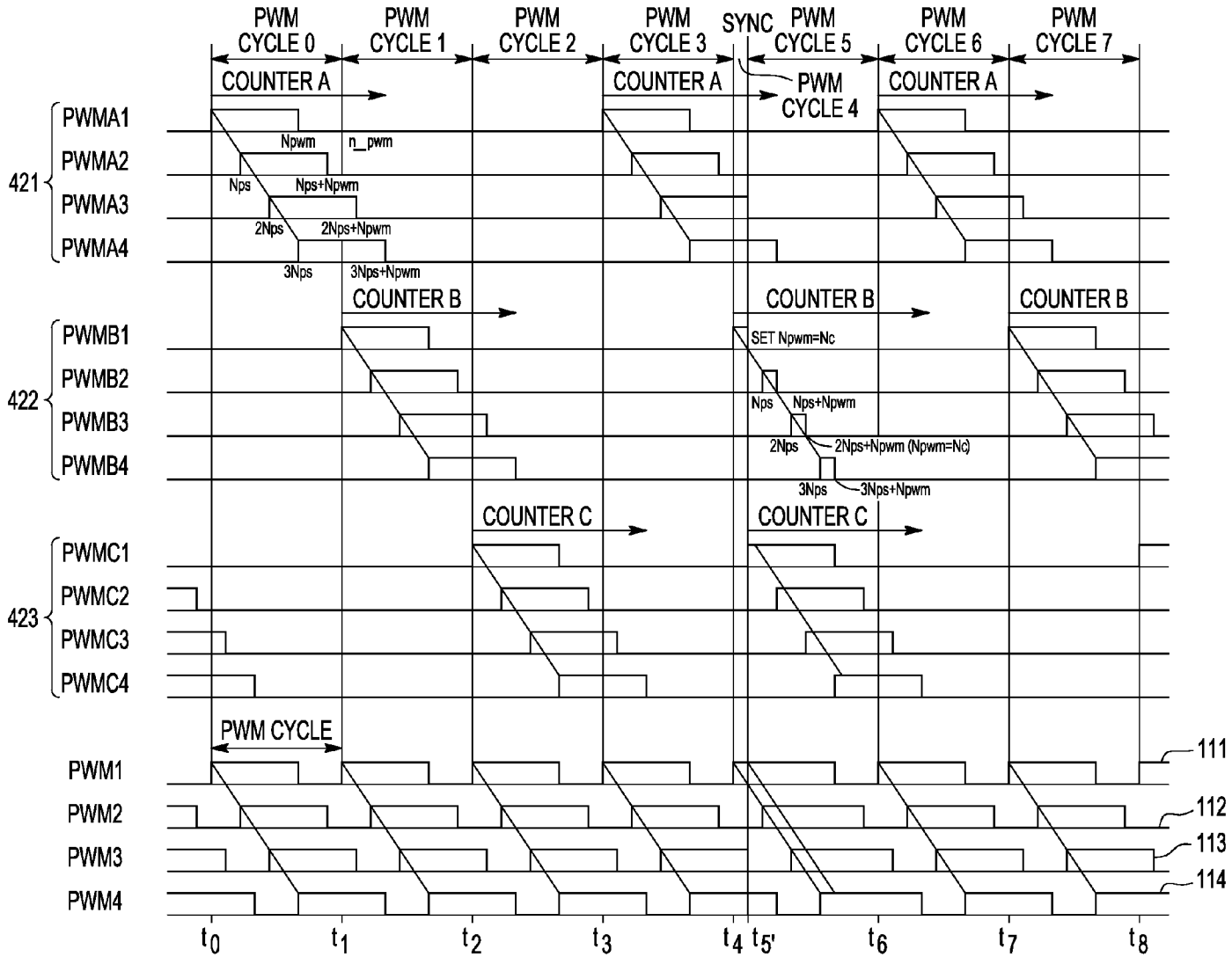
FIG. 8 is a timing diagram illustrating an example operation of the PWM generation module of FIG. 5 in the presence of a synchronization event occurring during a high segment of a PWM cycle of a leading output PWM signal in accordance with at least one embodiment of the present invention.

FIGS. 6-8 are timing diagrams illustrating example operations of the implementation of the PWM generation module 120 of FIG. 4 in accordance with the method 500 of operation of the signal generation units 411-13. FIG. 6 illustrates an example operation in the absence of a synchronization event (that is, in the absence of an assertion of the SYNC signal 115). FIG. 7 illustrates an example operation in the event of an assertion of the SYNC signal 115 after generation of the active segment for a leading intermediate PWM signal has completed. FIG. 8 illustrates an example operation in the event of an assertion of the SYNC signal 115 before the generation of an active segment for a leading intermediate PWM signal has completed. Note for the following examples the same value Npwm may be used for timing multiple successive output PWM cycles or each input PWM cycle may be sampled to refresh the value of Npwm for each corresponding output PWM cycle.

As illustrated by the timing diagram of FIG. 6, an output PWM cycle 0 starts at time $t_0$, in response to which the signal generation unit 411 initiates the counter 401 ("counter A") and begins generating the corresponding active segments for the set 421 of intermediate PWM signals PWMA1-PWMA4 using the value Npwm determined from the sampling process for a corresponding input PWM cycle of the input PWM signal 101 (FIG. 1). As illustrated, the active segment for the leading intermediate PWM signal PWMA1 is generated from when Count_A is at 0 at time $t_0$ until Count_A reaches Npwm. After a phase shift of Nps, that is, when Count_A=Nps, the active segment for the non-leading intermediate PWM signal PWMA2 is generated for the duration Npwm until Count_A=Nps+Npwm. After a phase shift of 2 Nps, the active segment for the non-leading intermediate PWM signal PWMA3 is generated for the duration Npwm until Count_A=2 Nps+Npwm. Similarly, after a phase shift of 3 Nps, the active segment for the non-leading intermediate PWM signal PWMA4 is generated for the duration Npwm until Count_A=3 Nps+Npwm.

In response to the counter 401 reaching the value n_pwm, that is, when Count_A=n_pwm, at time $t_1$, the signal generation unit 412 initializes for the next output PWM cycle 1 and begins the counter 402 ("counter B") so as to being generating the corresponding active segments for the set 422 of intermediate PWM signals PWMB1-PWMB4 for the output PWM cycle 1 in the same manner described above with respect to the signal generation unit 411. The timing of the generation of the active segments for the output PWM cycle 1 can use the same value for Npwm as used in the output PWM cycle 0, or the sampling module 118 (FIG. 1) can refresh the value for Npwm by performing the sample process again for a corresponding input PWM cycle of the input PWM signal 101. In response to the counter 402 reaching the value n_pwm, that is, when Count_B=n_pwm, the signal generation unit 413 initializes for the next output PWM cycle 2 and begins the counter 403 ("counter C") so as to being generating the corresponding active segments for the set 423 of intermediate PWM signals PWMC1-PWMC4 for the output PWM cycle 2 in the same manner described above. In response to the counter 403 reaching the value n_pwm, that is, when Count_C=n_pwm, at time $t_3$, the above-described process for output PWM cycles 0-2 is repeated again starting with the signal generation unit 411, then the signal generation unit 412, followed by the signal generation unit 413 for output PWM cycles 3-6, respectively, and so on.

The bottom of the timing diagram of FIG. 6 illustrates the combination of the intermediate PWM signals PWMA1, PWMB1, and PWMC1 via the OR gate 415 (FIG. 4) to generate the output PWM signal 111; the combination of the intermediate PWM signals PWMA2, PWMB2, and PWMC2 via the OR gate 416 (FIG. 4) to generate the output PWM signal 112; the combination of the intermediate PWM signals PWMA3, PWMB3, and PWMC3 via the OR gate 417 (FIG. 4) to generate the output PWM signal 113; and the combination of the intermediate PWM signals PWMA4, PWMB4, and PWMC4 via the OR gate 418 (FIG. 4) to generate the output PWM signal 114. As depicted, the effective duty ratios of the output PWM signals 111-114 are substantially equal and the relative phase shifts are maintained among the output PWM signals between output PWM cycles.

The timing diagram of FIG. 7 is similar to the timing diagram of FIG. 6. However, in the timing diagram of FIG. 7, the SYNC signal 115 is asserted at time $t_{2'}$, thereby prematurely terminating the output PWM cycle 1. The output PWM cycle 1 was initiated by the signal generation unit 412 and thus the count value Count_B is used to determine whether the active segment of the leading intermediate PWM signal PWMB1 was completed for the output PWM cycle 1 at the time of the assertion of the SYNC signal 115. That is, the active segment of the leading intermediate PWM signal PWMB1 is determined to be completed when Count_B is greater than the value Npwm at the time of the assertion of the SYNC signal 115. In the illustrated example, the assertion of the SYNC signal 115 at time $t_{2'}$ occurs after the generation of the active segment of the leading intermediate PWM signal PWMB1 has completed, and thus the operation of the signal generation unit 412 is not altered by the assertion of the SYNC signal 115. Accordingly, the signal generation unit 412 continues to generate the remaining active segments for the non-leading intermediate PWM signals PWMB2-PWMB4 using the unaltered value of Npwm for timing purposes.

As noted above with respect to the method 500 of FIG. 5, an assertion of the SYNC signal 115 causes the next available signal generation unit downstream of the active signal generation unit to initiate the next output PWM cycle. Accordingly, in response to the assertion of the SYNC signal 115 at time $t_{2'}$, the signal generation unit 413 initializes and begins the output PWM cycle 2 at time $t_{2'}$ by initiating generation of the active segment for the leading PWM signal PWMC1, followed by the generation of the active segments for the non-leading PWM signals PWMC2-PWMC4 with their respective fixed phase shifts. Once the count value Count_C reaches n_pwm at time $t_3$ and thus signaling the end of the output PWM cycle 2 for the leading PWM signal, the output PWM cycle 3 is initiated at time $t_3$ by the signal generation unit 411 and the above-identified process can be repeated for output PWM cycles 3-6 and so on.

The bottom of the timing diagram of FIG. 7 illustrates the above-described combinations of the intermediate PWM signals PWMA1-PWMA4, PWMB1-PWMB4, and PWMC1-PWMC4 to generate the output PWM signals 111-114. As illustrated by FIG. 7, the output PWM signals 111-114 are synchronized to the assertion of the SYNC signal 115 in that the output PWM cycle being generated at the time of the assertion is prematurely terminated and the next output PWM cycle is immediately initiated. As also illustrated by FIG. 7, the operation of the signal generation units 411-412 as described above permits the same portion of the prematurely-terminated PWM cycle 1 generated for the leading output PWM signal 111 to be replicated for each of the non-leading output PWM signals 112-114 while maintaining the fixed phase-shift relationships, and thus maintaining the same duty ratio between each of the output PWM signals 111-114 across each and every output PWM cycle.

FIG. 8 depicts a timing diagram in the event of an assertion of the SYNC signal 115 during generation of an active segment of the leading output PWM signal 111. In the depicted timing diagram, output PWM cycles 0-3 are generated in the manner described above with respect to the timing diagram of FIG. 6. At time $t_4$, the output PWM cycle 4 is initiated when the count value Count A reaches npwm from the output PWM cycle 3 and the signal generation unit 412 accordingly begins to generate the active segment for the leading intermediate PWM signal PWMB1. However, at time $t_{5'}$ the SYNC signal 115 is asserted prior to completion of this active segment (that is, while Count_B=Nc<Npwm). In response to the assertion of the SYNC signal 115 while the active segment of the leading intermediate PWM signal PWMB1 is being generated, the signal generation unit 412 terminates generation of the active segment of the leading intermediate PWM signal PWMB1 and sets its local copy of Npwm to the value Nc of the counter 402 at the time of the assertion of the SYNC signal 115. The signal generation unit 412 then uses this new value for Npwm (Npwm=Nc) to time the generation of the active segments of the non-leading intermediate PWM signals PWMB2-PWMB4 for the output PWM cycle 4 such that each active segment of the non-leading intermediate PWM signals PWMB2-PWMB4 are substantially equal in duration to the prematurely-terminated active segment of the leading intermediate PWM signal PWMB1, while maintaining the predetermined phase-shifts between the intermediate PWM signals. Note that the premature termination of the output PWM cycle 4 does not stop or reset the counter 402 and thus the count value Count_B continues the increment for each cycle of the PWM timing signal 132. As illustrated, the duration of the active segment for the leading PWM signal PWMB1 has a duration Nc (that is, Count B=Nc at the time of the assertion of the SYNC signal 115), and thus the shortened active segment for the non-leading PWM signal PWMB2 starts when Count_B reaches Nps and ends when Count B reaches Nps+Npwm (=Nps+Nc), the shortened active segment for the non-leading PWM signal PWMB3 starts when Count_B reaches 2 Nps and ends when Count_B reaches 2 Nps+Npwm (=2 Nps+Nc), the shortened active segment for the non-leading PWM signal PWMB4 starts when Count_B reaches 3 Nps and ends when Count_B reaches 3 Nps+Npwm (=3 Nps+Nc).

As also illustrated, the assertion of the SYNC signal 115 at time $t_5$, causes the signal generation unit 413, which is downstream from the signal generation unit 412, to initiate an output PWM cycle 5 so as to generate active segments for the set 423 of intermediate PWM signals PWMC1-PWMC4. The process of cycling through the signal generation units 411-413 for each successive output PWM cycle can continue in the manner described above.

The bottom of the timing diagram of FIG. 8 illustrates the above-described combinations of the intermediate PWM signals PWMA1-PWMA4, PWMB1-PWMB4, and PWMC1-PWMC4 to generate the output PWM signals 111-114. As illustrated by FIG. 8, the output PWM signals 111-114 are synchronized to the assertion of the SYNC signal 115 in that the output PWM cycle 4 being generated at the time of the assertion is prematurely terminated and the next output PWM cycle 5 is immediately initiated. As also illustrated by FIG. 8, the operation of the signal generation units 411-413 as described above permits the same portion of the prematurely-terminated active segment generated for the leading output PWM signal 111 to be replicated for each of the non-leading output PWM signals 112-114 while maintaining the fixed phase-shift relationships, and thus maintaining the same duty ratio between each of the output PWM signals 111-114 across each and every output PWM cycle.

Figure 9:
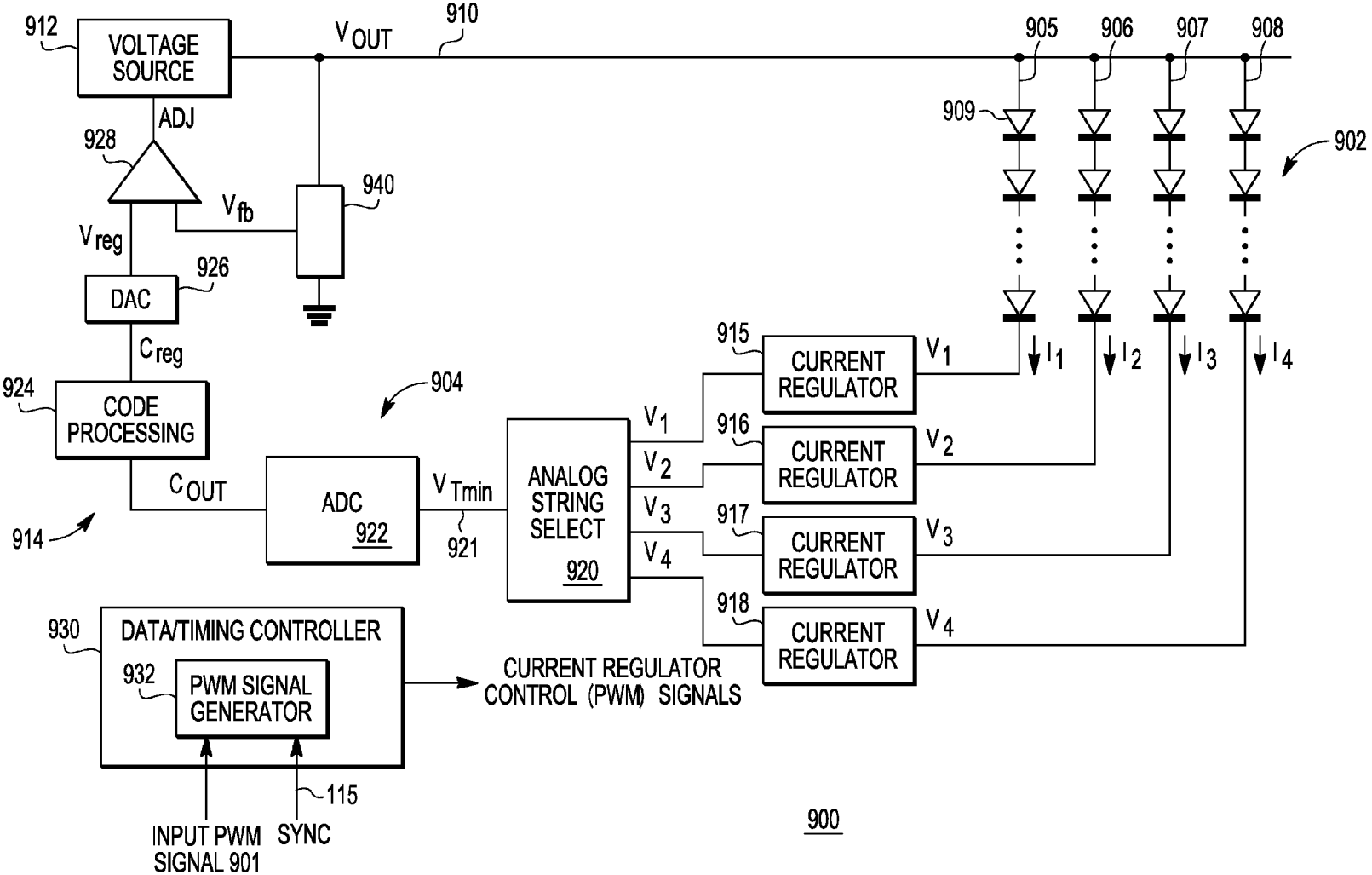
FIG. 9 is a diagram illustrating an example light emitting diode (LED) system implementing the PWM signal generator of FIG. 1 in accordance with at least one embodiment of the present invention.

FIG. 9 illustrates an example implementation of the PWM signal generator 100 of FIGS. 1 and 4 for dynamic power management in a light emitting diode (LED) system 900 having a plurality of LED strings. The term "LED string," as used herein, refers to a grouping of one or more LEDs connected in series. The "head end" of a LED string is the end or portion of the LED string which receives the driving voltage/current and the "tail end" of the LED string is the opposite end or portion of the LED string. The term "tail voltage," as used herein, refers the voltage at the tail end of a LED string or representation thereof (e.g., a voltage-divided representation, an amplified representation, etc.). The term "subset of LED strings" refers to one or more LED strings.

In the depicted example, the LED system 900 includes a LED panel 902 and a LED driver 904. The LED panel 902 includes a plurality of LED strings (e.g., LED strings 905, 906, 907, and 908). Each LED string includes one or more LEDs 909 connected in series. The LEDs 909 can include, for example, white LEDs, red, green, blue (RGB) LEDs, organic LEDs (OLEDs), etc. Each LED string is driven by the adjustable voltage $V_{OUT}$ received at the head end of the LED string from a voltage source 912 of the LED driver 904 via a voltage bus 910 (e.g., a conductive trace, wire, etc.). In the embodiment of FIG. 9, the voltage source 912 is implemented as a DC/DC converter configured to drive the output voltage $V_{OUT}$ using a supplied input voltage.

The LED driver 904 includes a feedback controller 914 configured to control the voltage source 912 based on the tail voltages at the tail ends of the LED strings 905-908. The LED driver 904, in one embodiment, receives an input PWM signal 901 (corresponding to input PWM signal 101) identifying the duty ratio at which the LED strings 905-908 are to be driven, and the LED driver 904 is configured to activate the LED strings 905-908 based on the input PWM signal 101.

The feedback controller 914, in one embodiment, includes a plurality of current regulators (e.g., current regulators 915, 916, 917, and 918), an analog string select module 920, an ADC 922, a code processing module 924, a control digital-to-analog converter (DAC) 926, an error amplifier 928, and a data/timing controller 930. The data/timing controller 930 includes a PWM signal generator 932 (corresponding to the PWM signal generator 100, FIG. 1).

The current regulator 915 is configured to maintain the current $I_1$ flowing through the LED string 905 at or near a fixed current (e.g., 90 mA) when active. Likewise, the current regulators 916, 917, and 918 are configured to maintain the currents $I_2$, $I_3$, and $I_4$ flowing through the LED strings 906, 907, and 908, respectively, at or near the fixed current when active.

A current regulator typically operates more effectively when the input of the current regulator is a non-zero voltage so as to accommodate the variation in the input voltage that often results from the current regulation process of the current regulator. This buffering voltage often is referred to as the "headroom" of the current regulator. As the current regulators 915-918 are connected to the tail ends of the LED strings 905-908, respectively, the tail voltages of the LED strings 905-908 represent the amounts of headroom available at the corresponding current regulators 915-918. However, headroom in excess of that necessary for current regulation purposes results in unnecessary power consumption by the current regulator. Accordingly, as described in greater detail herein, the LED system 900 employs techniques to provide dynamic headroom control so as to maintain the minimum tail voltage of the active LED strings at or near a predetermined threshold voltage, thus maintaining the lowest headroom of the current regulators 915-918 at or near the predetermined threshold voltage. The threshold voltage can represent a determined balance between the need for sufficient headroom to permit proper current regulation by the current regulators 915-918 and the advantage of reduced power consumption by reducing the excess headroom at the current regulators 915-918.

The data/timing controller 930 receives the input PWM signal 901 and the SYNC signal 115. The PWM signal generator 932 then generates a set of four output PWM signals in accordance with the techniques described above. Each output PWM signal is provided to a corresponding current regulator to control the activation of the corresponding LED strings. Likewise, as the output PWM signals are phase shifted relative to each other, the potential for ripple in the voltage $V_{OUT}$ provided by the voltage source 912 can be reduced, as can audible noise and visual flickering that could otherwise occur if all of the LED strings were to be activated and deactivated simultaneously. Further, by synchronizing the output PWM signals to the frame rate represented by the SYNC signal 115, beating and other visual noise can be reduced or eliminated.

The analog string select module 920 includes a plurality of tail inputs coupled to the tail ends of the LED strings 905-908 to receive the tail voltages $V_{T1}$, $V_{T2}$, $V_{T3}$, and $V_{T4}$ of the LED strings 905-908, respectively, and an output to provide an analog signal 921 representative of the minimum tail voltage $V_{Tmin}$ of the LED strings 905-908 at any given point over a detection period. In one embodiment, the analog string select module 920 is implemented as a diode-OR circuit having a plurality of inputs connected to the tail ends of the LED strings 905-908 and an output to provide the analog signal 921.

The ADC 922 is configured to generate one or more digital code values $C_{OUT}$ representative of the voltage of the analog signal 921 at one or more corresponding sample points. The code processing module 924 includes an input to receive the one or more code values $C_{OUT}$ and an output to provide a code value $C_{reg}$ based on the minimum value of the received code values $C_{OUT}$ for a given detection period or a previous value for $C_{reg}$ from a previous detection period. As the code value $C_{OUT}$ represents the minimum tail voltage that occurred during the detection period (e.g., a PWM cycle, a display frame period, etc.) for all of the LED strings 905-908, the code processing module 924, in one embodiment, compares the code value $C_{OUT}$ to a threshold code value, $C_{thresh}$, and generates a code value $C_{reg}$ based on the comparison. The code processing module 924 can be implemented as hardware, software executed by one or more processors, or a combination thereof. To illustrate, the code processing module 924 can be implemented as a logic-based hardware state machine, software executed by a processor, and the like.

The control DAC 926 includes an input to receive the code value $C_{reg}$ and an output to provide a regulation voltage $V_{reg}$ representative of the code value $C_{reg}$. The regulation voltage $V_{reg}$ is provided to the error amplifier 928. The error amplifier 928 also receives a feedback voltage $V_{fb}$, representative of the output voltage $V_{OUT}$. In the illustrated embodiment, a voltage divider 940 is used to generate the voltage $V_{fb}$, from the output voltage $V_{OUT}$. The error amplifier 928 compares the voltage $V_{fb}$, and the voltage $V_{reg}$ and configures a signal ADJ based on this comparison. The voltage source 912 receives the signal ADJ and adjusts the output voltage $V_{OUT}$ based on the magnitude of the signal ADJ.

There may be considerable variation between the voltage drops across each of the LED strings 905-908 in the LED system 900 due to static variations in forward-voltage biases of the LEDs 909 of each LED string and dynamic variations due to the on/off cycling of the LEDs 909. Thus, there may be significant variance in the bias voltages needed to properly operate the LED strings 905-908. However, rather than drive a fixed output voltage $V_{OUT}$ that is substantially higher than what is needed for the smallest voltage drop as this is handled in conventional LED drivers, the LED driver 904 illustrated in FIG. 9 utilizes a feedback mechanism that permits the output voltage $V_{OUT}$ to be adjusted so as to reduce or minimize the power consumption of the LED driver 904 in the presence of variances in voltage drop across the LED strings 905-908. Further, by phase-shifting the output PWM signals used to drive the LED strings 905-908, the LED drivers 904 can experience less voltage ripple at the output voltage $V_{OUT}$, as well as reduce or eliminate audible and visual noise. Moreover, by using the SYNC signal 115 to synchronize the generation of the output PWM signals, the LED system 900 can avoid beating and other visual noise artifacts that otherwise would result from a lack of synchronization between the output PWM signals and the frame rate of the video displayed via the LED system 900.

In accordance with one aspect of the present disclosure, a method includes receiving, at a pulse width modulation (PWM) signal generator, an input PWM signal and generating, at the PWM signal generator and based on the input PWM signal, multiple output PWM signals that have duty ratios substantially equal to a duty ratio of the input PWM signal and that are synchronized to a synchronization signal. The multiple output PWM signals have predetermined phase-shifts in relation to each other, and are generated such that a PWM cycle of a leading output PWM signal of the multiple output PWM signals is prematurely terminated in response to a synchronization event represented by the synchronization signal so as to result in a prematurely-terminated PWM cycle for the leading output PWM signal and such that the prematurely-terminated PWM cycle is replicated for each of the non-leading PWM signals of the multiple output PWM signals while maintaining the predetermined phase-shifts between the multiple output PWM signals. The synchronization signal can comprise a video frame synchronization signal and the synchronization event comprises an assertion of the video frame synchronization signal. In one embodiment, the method further includes controlling a plurality of light emitting diode (LED) strings using the multiple output PWM signals.

In one embodiment, the PWM cycle comprises a first PWM cycle and generating the multiple output PWM signals comprises initiating generation of the first PWM cycle for a first set of intermediate PWM signals at a first signal generation unit of the PWM signal generator, the first set of intermediate PWM signals having the predetermined phase-shifts in relation to each other, prematurely terminating generation of the first PWM cycle for a leading intermediate PWM signal of the first set in response to the synchronization event, replicating a completed portion of the first PWM cycle for the leading intermediate PWM signal for the first PWM cycle of each non-leading intermediate PWM signal of the first set, generating a second PWM cycle for a second set of intermediate PWM signals at a second signal generation unit of the PWM signal generator in response to the synchronization event, the second set of intermediate PWM signals having the predetermined phase-shifts in relation to each other, and combining each intermediate PWM signal of the first set with a corresponding intermediate PWM signal of the second set to generate the multiple output PWM signals. Further, the method can include generating a third PWM cycle for a third set of intermediate PWM signals at a third signal generation unit of the PWM signal generator in response to a completion of the second PWM cycle, wherein combining each intermediate PWM signal of the first set with a corresponding intermediate PWM signal of the second set comprises combining each intermediate PWM signal of the first set with a corresponding intermediate PWM signal of the second set and a corresponding intermediate PWM signal of the third set to generate the multiple output PWM signals. Moreover, in one embodiment, the method can include sampling, at the PWM signal generator, a first PWM cycle of the input PWM signal to determine a first value representative of a duty ratio of the first PWM cycle of the input PWM signal, and sampling, at the PWM signal generator, a second PWM cycle of the input PWM signal following the first PWM cycle of the input PWM signal to determine a second value representative of a duty ratio of the second PWM cycle of the input PWM signal. In this instance, initiating generation of the first PWM cycle for the first set of intermediate PWM signals comprises timing generation of active segments of the first PWM cycle for each intermediate PWM signal of the first set based on the first value, and generating the second PWM cycle for the second set of intermediate PWM signals comprises timing generation of active segments of the second PWM cycle for each intermediate PWM signal of the second set based on the second value.

In another embodiment, the method also can include sampling, at the PWM signal generator, a PWM cycle of the input PWM signal to determine a value representative of a duty ratio of the PWM cycle, wherein generating the multiple output PWM signals comprises timing the multiple output PWM signals based on the value.

In accordance with another aspect of the present disclosure, a method is provided in a pulse width modulation (PWM) signal generator receiving an input PWM signal and outputting a plurality of output PWM signals synchronized to a synchronization signal, each output PWM signal phase-shifted in relation to the other output PWM signals. The method comprises initiating generation of a first PWM cycle for a leading output PWM signal of the plurality of output PWM signals at a first time, prematurely terminating generation of the first PWM cycle for the leading PWM signal in response to a synchronization event represented by the synchronization signal at a second time following the first time, replicating that portion of the first PWM cycle for the leading PWM signal generated prior to the second time for a first PWM cycle of each non-leading output PWM signal of the plurality of output PWM signals, the first PWM cycle of each non-leading output PWM signal corresponding to the first PWM cycle of the leading output PWM signal, generating a second PWM cycle for the leading output PWM signal in response to the synchronization event, and generating a second PWM cycle for each non-leading output PWM signal in response to the synchronization event, the second PWM cycle of each non-leading output PWM signal corresponding to the second PWM cycle of the leading output PWM signal. In one embodiment, the method further includes controlling a plurality of light emitting diode (LED) strings using the plurality of output PWM signals. In one embodiment, the synchronization signal is a video frame synchronization signal and the synchronization event comprises an assertion of the video frame synchronization signal.

In accordance with yet another aspect of the present disclosure, a system is provided. The system includes a pulse width modulation (PWM) signal generator comprising an input to receive an input PWM signal and outputs to provide multiple output PWM signals, the PWM signal generator to generate the multiple output PWM signals having substantially equal duty ratios and that are synchronized to a synchronization signal and having predetermined phase-shifts in relation to each other. The PWM signal generator generates the multiple output PWM signals such that a PWM cycle of a leading output PWM signal of the multiple output PWM signals is prematurely terminated in response to a synchronization event represented by the synchronization signal so as to result in a prematurely-terminated PWM cycle for the leading output PWM signal and such that the prematurely-terminated PWM cycle is replicated for each of the non-leading PWM signals of the multiple output PWM signals while maintaining the predetermined phase-shifts between the multiple output PWM signals. In one embodiment, the system further includes a display comprising a plurality of light emitting diode (LED) strings and a plurality of current regulators, each current regulator to regulate a current through a corresponding LED string using a corresponding output PWM signal of the plurality of output PWM signals. The synchronization signal can include a video frame synchronization signal and the synchronization event can comprise an assertion of the video frame synchronization signal.

In one embodiment, the PWM cycle comprises a first PWM cycle and wherein the PWM signal generator is to generate the multiple output PWM signals by: initiating generation of the first PWM cycle for a first set of intermediate PWM signals at a first signal generation unit of the PWM signal generator, the first set of intermediate PWM signals having the predetermined phase-shifts in relation to each other; prematurely terminating generation of the first PWM cycle for a leading intermediate PWM signal of the first set in response to the synchronization event; replicating a completed portion of the first PWM cycle for the leading intermediate PWM signal for the first PWM cycle of each non-leading intermediate PWM signal of the first set; generating a second PWM cycle for a second set of intermediate PWM signals at a second signal generation unit of the PWM signal generator in response to the synchronization event, the second set of intermediate PWM signals having the predetermined phase-shifts in relation to each other; and combining each intermediate PWM signal of the first set with a corresponding intermediate PWM signal of the second set to generate the multiple output PWM signals. The PWM signal generator further can generate a third PWM cycle for a third set of intermediate PWM signals at a third signal generation unit of the PWM signal generator in response to a completion of the second PWM cycle, and wherein the PWM signal generator is to combine each intermediate PWM signal of the first set with a corresponding intermediate PWM signal of the second set and a corresponding intermediate PWM signal of the third set to generate the multiple output PWM signals. Further, in one embodiment, the PWM signal generator comprises a sampling module, the sampling module to sample a first PWM cycle of the input PWM signal to determine a first value representative of a duty ratio of the first PWM cycle of the input PWM signal and sample a second PWM cycle of the input PWM signal following the first PWM cycle of the input PWM signal to determine a second value representative of a duty ratio of the second PWM cycle of the input PWM signal, and the PWM signal generator is to initiate generation of the first PWM cycle for the first set of intermediate PWM signals by timing generation of active segments of the first PWM cycle for each intermediate PWM signal of the first set based on the first value, and the PWM signal generator is to generate the second PWM cycle for the second set of intermediate PWM signals by timing generation of active segments of the second PWM cycle for each intermediate PWM signal of the second set based on the second value.

In one embodiment, the PWM signal generator further comprises a sampling module to sample a PWM cycle of the input PWM signal to determine a value representative of a duty ratio of the PWM cycle. In this instance, the PWM signal generator is to generate the multiple output PWM signals by timing the multiple output PWM signals based on the value.

In one embodiment, the PWM signal generator comprises a first signal generation unit to generate a first set of intermediate PWM signals based on a first count value of a first counter, the first set of intermediate PWM signals having the predetermined phase-shifts in relation to each other. The PWM signal generator also comprises a second signal generation unit to generate a second set of intermediate PWM signals based on a second count value of a second counter, the second set of intermediate PWM signals having the predetermined phase-shifts in relation to each other. The PWM signal generator further comprises a third signal generation unit to generate a third set of intermediate PWM signals based on a third count value of a third counter, the third set of intermediate PWM signals having the predetermined phase-shifts in relation to each other. The PWM signal generator additionally includes a signal combination module to combine the first set of intermediate PWM signals, the second set of intermediate PWM signals, and the third set of intermediate PWM signals to generate the multiple output PWM signals. In one embodiment, the first signal generation unit is to initiate generation of a PWM cycle for the first set of intermediate PWM signals responsive to an assertion of a first signal and the first signal generation unit is to assert a second signal responsive to completing generation of the PWM cycle for the first set, the second signal generation unit is to initiate generation of a PWM cycle for the second set of intermediate PWM signals responsive to the assertion of the second signal and the second signal generation unit is to assert a third signal responsive to completing generation of the PWM cycle for the second set, and the third signal generation unit is to initiate generation of a PWM cycle for the third set of intermediate PWM signals responsive to the assertion of the third signal and the third signal generation unit is to assert the first signal responsive to completing generation of the PWM cycle for the third set. Further, in one embodiment, the signal combination module comprises a first OR gate having a first input to receive a first intermediate PWM signal of the first set, a second input to receive a first intermediate PWM signal of the second set, and a third input to receive a first intermediate PWM signal of the third set, and an output to provide a first output PWM signal of the multiple output PWM signals. The signal combination module further comprises a second OR gate having a first input to receive a second intermediate PWM signal of the first set, a second input to receive a second intermediate PWM signal of the second set, and a third input to receive a second intermediate PWM signal of the third set, and an output to provide a second output PWM signal of the multiple output PWM signals.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

The invention claimed is:

1. A method comprising:

receiving, at a pulse width modulation (PWM) signal generator, an input PWM signal; and generating, at the PWM signal generator and based on the input PWM signal, multiple output PWM signals that have duty ratios substantially equal to a duty ratio of the input PWM signal and that are synchronized to a synchronization signal and that have predetermined phase-shifts in relation to each other, and such that a PWM cycle of a leading output PWM signal of the multiple output PWM signals is prematurely terminated in response to a synchronization event represented by the synchronization signal so as to result in a prematurely-terminated PWM cycle for the leading output PWM signal and such that the prematurely-terminated PWM cycle is replicated for each non-leading PWM signal of the multiple output PWM signals while maintaining the predetermined phase-shifts between the multiple output PWM signals.

2. The method of claim 1, further comprising:

controlling a plurality of light emitting diode (LED) strings using the multiple output PWM signals.

3. The method of claim 1, wherein the synchronization signal is a video frame synchronization signal and wherein the synchronization event comprises an assertion of the video frame synchronization signal.

4. The method of claim 1, wherein the PWM cycle comprises a first PWM cycle and generating the multiple output PWM signals comprises:

initiating generation of the first PWM cycle for a first set of intermediate PWM signals at a first signal generation unit of the PWM signal generator, the first set of intermediate PWM signals having the predetermined phase-shifts in relation to each other;

prematurely terminating generation of the first PWM cycle for a leading intermediate PWM signal of the first set in response to the synchronization event;

replicating a completed portion of the first PWM cycle for the leading intermediate PWM signal for the first PWM cycle of each non-leading intermediate PWM signal of the first set;

generating a second PWM cycle for a second set of intermediate PWM signals at a second signal generation unit of the PWM signal generator in response to the synchronization event, the second set of intermediate PWM signals having the predetermined phase-shifts in relation to each other; and combining each intermediate PWM signal of the first set with a corresponding intermediate PWM signal of the second set to generate the multiple output PWM signals.

5. The method of claim 4, further comprising:

generating a third PWM cycle for a third set of intermediate PWM signals at a third signal generation unit of the PWM signal generator in response to a completion of the second PWM cycle; and wherein combining each intermediate PWM signal of the first set with a corresponding intermediate PWM signal of the second set comprises combining each intermediate PWM signal of the first set with a corresponding intermediate PWM signal of the second set and a corresponding intermediate PWM signal of the third set to generate the multiple output PWM signals.

6. The method of claim 4, further comprising:

sampling, at the PWM signal generator, a first PWM cycle of the input PWM signal to determine a first value representative of a duty ratio of the first PWM cycle of the input PWM signal;

sampling, at the PWM signal generator, a second PWM cycle of the input PWM signal following the first PWM cycle of the input PWM signal to determine a second value representative of a duty ratio of the second PWM cycle of the input PWM signal;

wherein initiating generation of the first PWM cycle for the first set of intermediate PWM signals comprises timing generation of active segments of the first PWM cycle for each intermediate PWM signal of the first set based on the first value; and wherein generating the second PWM cycle for the second set of intermediate PWM signals comprises timing generation of active segments of the second PWM cycle for each intermediate PWM signal of the second set based on the second value.

7. The method of claim 1, further comprising:

sampling, at the PWM signal generator, a PWM cycle of the input PWM signal to determine a value representative of a duty ratio of the PWM cycle; and wherein generating the multiple output PWM signals comprises timing the multiple output PWM signals based on the value.

8. In a pulse width modulation (PWM) signal generator receiving an input PWM signal and outputting a plurality of output PWM signals synchronized to a synchronization signal, each output PWM signal phase-shifted in relation to the other output PWM signals, a method comprising:

initiating generation of a first PWM cycle for a leading output PWM signal of the plurality of output PWM signals at a first time;

prematurely terminating generation of the first PWM cycle for the leading output PWM signal in response to a synchronization event represented by the synchronization signal at a second time following the first time;

replicating that portion of the first PWM cycle for the leading output PWM signal generated prior to the second time for a first PWM cycle of each non-leading output PWM signal of the plurality of output PWM signals, the first PWM cycle of each non-leading output PWM signal corresponding to the first PWM cycle of the leading output PWM signal;

generating a second PWM cycle for the leading output PWM signal in response to the synchronization event; and generating a second PWM cycle for each non-leading output PWM signal in response to the synchronization event, the second PWM cycle of each non-leading output PWM signal corresponding to the second PWM cycle of the leading output PWM signal.

9. The method of claim 8, further comprising:

controlling a plurality of light emitting diode (LED) strings using the plurality of output PWM signals.

10. The method of claim 8, wherein the synchronization signal is a video frame synchronization signal and wherein the synchronization event comprises an assertion of the video frame synchronization signal.

11. A system comprising:

a pulse width modulation (PWM) signal generator comprising an input to receive an input PWM signal and outputs to provide multiple output PWM signals, the PWM signal generator to generate the multiple output PWM signals having substantially equal duty ratios and that are synchronized to a synchronization signal and having predetermined phase-shifts in relation to each other, and such that a PWM cycle of a leading output PWM signal of the multiple output PWM signals is prematurely terminated in response to a synchronization event represented by the synchronization signal so as to result in a prematurely-terminated PWM cycle for the leading output PWM signal and such that the prematurely-terminated PWM cycle is replicated for each of the non-leading output PWM signals of the multiple output PWM signals while maintaining the predetermined phase-shifts between the multiple output PWM signals.

12. The system of claim 11, further comprising:

a display comprising a plurality of light emitting diode (LED) strings and a plurality of current regulators, each current regulator to regulate a current through a corresponding LED string using a corresponding output PWM signal of the multiple output PWM signals.

13. The system of claim 11, wherein the synchronization signal is a video frame synchronization signal and wherein the synchronization event comprises an assertion of the video frame synchronization signal.

14. The system of claim 11, wherein the PWM cycle comprises a first PWM cycle and wherein the PWM signal generator is to generate the multiple output PWM signals by: initiating generation of the first PWM cycle for a first set of intermediate PWM signals at a first signal generation unit of the PWM signal generator, the first set of intermediate PWM signals having the predetermined phase-shifts in relation to each other; prematurely terminating generation of the first PWM cycle for a leading intermediate PWM signal of the first set in response to the synchronization event; replicating a completed portion of the first PWM cycle for the leading intermediate PWM signal for the first PWM cycle of each non-leading intermediate PWM signal of the first set; generating a second PWM cycle for a second set of intermediate PWM signals at a second signal generation unit of the PWM signal generator in response to the synchronization event, the second set of intermediate PWM signals having the predetermined phase-shifts in relation to each other; and combining each intermediate PWM signal of the first set with a corresponding intermediate PWM signal of the second set to generate the multiple output PWM signals.

15. The system of claim 14, wherein the PWM signal generator further is to generate a third PWM cycle for a third set of intermediate PWM signals at a third signal generation unit of the PWM signal generator in response to a completion of the second PWM cycle, and wherein the PWM signal generator is to combine each intermediate PWM signal of the first set with a corresponding intermediate PWM signal of the second set and a corresponding intermediate PWM signal of the third set to generate the multiple output PWM signals.

16. The system of claim 14, wherein:

the PWM signal generator comprises a sampling module, the sampling module to sample a first PWM cycle of the input PWM signal to determine a first value representative of a duty ratio of the first PWM cycle of the input PWM signal and sample a second PWM cycle of the input PWM signal following the first PWM cycle of the input PWM signal to determine a second value representative of a duty ratio of the second PWM cycle of the input PWM signal; and the PWM signal generator is to initiate generation of the first PWM cycle for the first set of intermediate PWM signals by timing generation of active segments of the first PWM cycle for each intermediate PWM signal of the first set based on the first value, and the PWM signal generator is to generate the second PWM cycle for the second set of intermediate PWM signals by timing generation of active segments of the second PWM cycle for each intermediate PWM signal of the second set based on the second value.

17. The system of claim 11, wherein:

the PWM signal generator further comprises a sampling module to sample a PWM cycle of the input PWM signal to determine a value representative of a duty ratio of the PWM cycle; and the PWM signal generator is to generate the multiple output PWM signals by timing the multiple output PWM signals based on the value.

18. The system of claim 11, wherein the PWM signal generator comprises:

a first signal generation unit to generate a first set of intermediate PWM signals based on a first count value of a first counter, the first set of intermediate PWM signals having the predetermined phase-shifts in relation to each other;

a second signal generation unit to generate a second set of intermediate PWM signals based on a second count value of a second counter, the second set of intermediate PWM signals having the predetermined phase-shifts in relation to each other;

a third signal generation unit to generate a third set of intermediate PWM signals based on a third count value of a third counter, the third set of intermediate PWM signals having the predetermined phase-shifts in relation to each other; and a signal combination module to combine the first set of intermediate PWM signals, the second set of intermediate PWM signals, and the third set of intermediate PWM signals to generate the multiple output PWM signals.

19. The system of claim 18, wherein:

the first signal generation unit is to initiate generation of a PWM cycle for the first set of intermediate PWM signals responsive to an assertion of a first signal and the first signal generation unit is to assert a second signal responsive to completing generation of the PWM cycle for the first set;

the second signal generation unit is to initiate generation of a PWM cycle for the second set of intermediate PWM signals responsive to the assertion of the second signal and the second signal generation unit is to assert a third signal responsive to completing generation of the PWM cycle for the second set; and the third signal generation unit is to initiate generation of a PWM cycle for the third set of intermediate PWM signals responsive to the assertion of the third signal and the third signal generation unit is to assert the first signal responsive to completing generation of the PWM cycle for the third set.

20. The system of claim 18, wherein the signal combination module comprises:

a first OR gate having a first input to receive a first intermediate PWM signal of the first set, a second input to receive a first intermediate PWM signal of the second set, and a third input to receive a first intermediate PWM signal of the third set, and an output to provide a first output PWM signal of the multiple output PWM signals; and a second OR gate having a first input to receive a second intermediate PWM signal of the first set, a second input to receive a second intermediate PWM signal of the second set, and a third input to receive a second intermediate PWM signal of the third set, and an output to provide a second output PWM signal of the multiple output PWM signals.

* * * * *